US011386828B2

(12) United States Patent
Kim et al.

(10) Patent No.: US 11,386,828 B2
(45) Date of Patent: Jul. 12, 2022

(54) DISPLAY DEVICE

(71) Applicant: Samsung Display Co., Ltd., Yongin-si (KR)

(72) Inventors: Min Weun Kim, Yongin-si (KR); Chan Gyeong Lee, Yongin-si (KR); Hyeong Uk Lee, Yongin-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 89 days.

(21) Appl. No.: 16/887,684

(22) Filed: May 29, 2020

(65) Prior Publication Data

US 2021/0110752 A1 Apr. 15, 2021

(30) Foreign Application Priority Data

Oct. 10, 2019 (KR) ..... 10-2019-0125409

(51) Int. Cl.
*G09G 3/20* (2006.01)

(52) U.S. Cl.
CPC ... *G09G 3/2003* (2013.01); *G09G 2300/0452* (2013.01); *G09G 2310/027* (2013.01); *G09G 2320/0276* (2013.01); *G09G 2330/00* (2013.01)

(58) Field of Classification Search
None
See application file for complete search history.

(56) References Cited

U.S. PATENT DOCUMENTS 6,329,980 B1 * 12/2001 Uehara ..... G09G 3/3611 345/204
7,260,267 B2 * 8/2007 Sugimoto ..... G06T 5/009 348/241
9,792,852 B2 * 10/2017 Nakahata ..... G09G 3/3225
2001/0015711 A1 * 8/2001 Aoki ..... G09G 3/3688 345/92
2003/0103058 A1 * 6/2003 Hellen Brown Elliott ..... G09G 3/2003 345/589
2003/0122759 A1 * 7/2003 Abe ..... G09G 3/22 345/89
2005/0151883 A1 * 7/2005 Arai ..... G09G 3/20 348/E5.073

(Continued)

FOREIGN PATENT DOCUMENTS

KR 10-0923053 B1 10/2009
WO WO 03/015066 A2 2/2003

*Primary Examiner* — Patrick N Edouard
*Assistant Examiner* — Peijie Shen
(74) *Attorney, Agent, or Firm* — Lewis Roca Rothgerber Christie LLP

(57) ABSTRACT

A display device may include a display panel including a plurality of pixels. An interpolator may be configured to generate a first voltage value corresponding to an input data value using a preset gamma lookup table. A gamma compensator may be configured to, based on a dimming value, select at least one of a plurality of preset dimming lookup tables, and may calculate a first output data value by correcting the first voltage value based on the at least one dimming lookup table. A gamma voltage generator may be configured to generate a plurality of gamma voltages having a linear relationship. A data driver may be configured to select a first gamma voltage from among the gamma voltages based on the first output data value, and provide the first gamma voltage, as a data voltage, to the display panel.

16 Claims, 11 Drawing Sheets

(56) References Cited

U.S. PATENT DOCUMENTS

2008/0150969 A1* 6/2008 Sagano ..... G09G 3/2014 345/690
2008/0170014 A1* 7/2008 Jung ..... G09G 3/3233 345/82
2009/0083507 A1* 3/2009 Moore ..... G06F 7/582 711/E12.002
2009/0256854 A1* 10/2009 Mizukoshi ..... G09G 3/3233 345/589
2010/0053137 A1* 3/2010 Park ..... G09G 3/3225 345/690
2010/0149162 A1* 6/2010 Park ..... G09G 3/2007 345/212
2011/0157134 A1* 6/2011 Ogura ..... G09G 3/20 345/82
2011/0187693 A1* 8/2011 Chung ..... G09G 5/00 345/211
2012/0007894 A1* 1/2012 Shin ..... G09G 3/3648 345/690
2013/0016118 A1* 1/2013 Mizushiro ..... H04N 9/3147 345/589
2014/0063079 A1* 3/2014 Lee ..... G09G 3/3258 345/77
2014/0152704 A1* 6/2014 Jeong ..... G09G 3/3233 345/690
2015/0097872 A1* 4/2015 Jeong ..... G09G 3/3225 345/77
2015/0187278 A1* 7/2015 Park ..... G09G 3/3291 345/212
2015/0364089 A1* 12/2015 Pyo ..... G09G 3/3258 345/77
2016/0055799 A1* 2/2016 Eom ..... G09G 3/3225 345/77
2016/0078813 A1* 3/2016 Mizukoshi ..... G09G 3/3233 438/23
2016/0104429 A1* 4/2016 Kang ..... G09G 3/3291 345/212
2016/0189635 A1* 6/2016 Lee ..... G09G 3/3233 345/77
2016/0240128 A1* 8/2016 Kim ..... G09G 3/3233
2017/0103707 A1* 4/2017 Park ..... G09G 3/3233
2018/0268759 A1* 9/2018 Wang ..... H04N 5/202
2019/0005888 A1* 1/2019 Kim ..... G09G 3/3291
2019/0156763 A1* 5/2019 Furihata ..... G09G 3/20
2019/0266952 A1* 8/2019 Pyo ..... G09G 3/3233
2020/0365087 A1* 11/2020 Chen ..... G09G 3/3258

* cited by examiner

| Gamma | 255 | 203 | 151 | 87 | 51 | 35 | 23 | 11 | 7 | 1 |
|---|---|---|---|---|---|---|---|---|---|---|
| Data Dim | – | – | 255 | 162 | 95 | 65 | 43 | 20 | 13 | 7 |
| 80 | 0 | 0 | 0 | 0 | 0 | 1 | 0 | 0 | 0 | 0 |
| 50 | 0 | 0 | 0 | 0 | 0 | 2 | 1 | 1 | 1 | 1 |
| 25 | 0 | 0 | 0 | 0 | 1 | 4 | 1 | 1 | 1 | 2 |
| 15 | 0 | 0 | 0 | 1 | 1 | 5 | 2 | 2 | 2 | 2 |
| 5 | 0 | 0 | 0 | 1 | 2 | 7 | 2 | 2 | 2 | 3 |
| 2 | 0 | 0 | 0 | 2 | 3 | **10** | 10 | 4 | 4 | 5 |

Inter-polation (Offset ^ ½)

Inter-polation (Offset x ratio)

DISPLAY DEVICE

CROSS-REFERENCE TO RELATED APPLICATION

This application claims priority to and the benefit of Korean patent application No. 10-2019-0125409, filed on Oct. 10, 2019, the entire disclosure of which is incorporated herein in its entirety by reference.

BACKGROUND

1. Field

Aspects of some example embodiments of the present disclosure relate to a display device.

2. Related Art

A display device generally includes a display panel and a driver. The display panel generally includes scan lines, data lines, and pixels. A driver generally includes a scan driver which sequentially provides scan signals to scan lines and a data driver which provides data signals to data lines. Each pixel may emit light with luminance (or brightness) corresponding to a data signal provided through the corresponding data line in response to a scan signal provided through the corresponding scan line.

The data driver may generate gamma voltages corresponding to a plurality of grayscales, and may convert the grayscale values of image data into data signals using the gamma voltages.

Due to the limited size of hardware, a data driver may generate only reference gamma voltages corresponding to some of the gamma voltages (i.e., reference gamma voltages corresponding to some tap points), and may generate gamma voltages by voltage-dividing the reference gamma voltages.

However, because the gamma voltages may be linearly interpolated between the reference gamma voltages, an image displayed using the gamma voltages may have a brightness error with respect to an image depending on an ideal gamma curve (e.g., a 2.2 gamma curve).

Further, when the display device is driven using a dimming driving scheme, the maximum brightness of the display device may decrease, and a load may be concentrated only on gamma voltages in some sections (e.g., gamma voltages corresponding to a low grayscale section), among the reference gamma voltages, and thus such brightness error may further increase.

The above information disclosed in this Background section is only for enhancement of understanding of the background and therefore the information discussed in this Background section does not necessarily constitute prior art.

SUMMARY

Aspects of some example embodiments of the present disclosure are directed to a display device that may be capable of reducing brightness errors.

According to some example embodiments of the present disclosure, a display device may include a display panel configured to include a plurality of pixels, a power supply configured to supply first and second supply voltages required to drive the pixels, a brightness compensator configured to generate a first data correction value corresponding to a voltage level of the second supply voltage, perform a multiply operation on a first input data value and the first data correction value, and then output a first corrected data value, an interpolator configured to calculate a first voltage value corresponding to the first corrected data value using a preset gamma lookup table, a first gamma compensator configured to calculate a first voltage correction value corresponding to a voltage level of the second supply voltage and to calculate a first output data value by performing an addition operation on the first voltage value and the first voltage correction value, a gamma voltage generator configured to generate a plurality of gamma voltages having a linear relationship, a data driver configured to select a first gamma voltage from among the gamma voltages based on the first output data value, and provide the first gamma voltage, as a data voltage, to the display panel.

According to some example embodiments, the first data correction value may be represented by P bits, where P is a natural number, the first input data value may be represented by Q bits, where Q is a natural number, and the first corrected data value may be represented by P+Q−1 bits.

According to some example embodiments, the interpolator may be configured to determine a range of the first voltage value based on high-order R bits of the first corrected data value, where R is a natural number less than P, and generate the first voltage value by interpolating the range of the first voltage value based on low-order bits of the first corrected data value indicating remaining bits of the first corrected data value.

According to some example embodiments, the gamma lookup table may include first gamma data, the first gamma data may include a minimum voltage value of the range of the first voltage value and a delta voltage value, and the delta voltage value may be a difference between a maximum voltage value of the range of the first voltage value and the minimum voltage value.

According to some example embodiments, the interpolator may interpolate the delta voltage value of the first gamma data based on the remaining bits of the first corrected data value.

According to some example embodiments, the display device may further include a second gamma compensator configured to select at least one of a plurality of preset dimming lookup tables based on a dimming value, correct the first output data value based on the at least one dimming lookup table, and then output the first corrected voltage value, wherein the data driver receives the first corrected voltage value as the first output data value.

According to some example embodiments, each of the dimming lookup tables may include gamma correction values that are set according to each of representative grayscale values, and the second gamma compensator may select a first dimming lookup table and a second dimming lookup table based on the dimming value, generate an interpolated lookup table by interpolating gamma correction values included in the first dimming lookup table and gamma correction values included in the second dimming lookup table based on the dimming value, and additionally correct the corrected voltage value using the interpolated lookup table.

According to some example embodiments, a number of representative grayscale values may be twice or more as large as a number of reference taps included in the gamma voltage generator.

According to some example embodiments, the second gamma compensator may generate a gamma correction value for the first corrected voltage value by interpolating correction values in the lookup table, and may perform an addition operation interpolated on the first corrected voltage value and the gamma correction value.

According to some example embodiments, each of the dimming lookup tables may further include an offset that is set for a first representative grayscale value, among the representative grayscale values, and based on the first representative grayscale value, the offset is set in proportion to a square root of the corresponding grayscale value as the grayscale value increases, and is set in proportion to the corresponding grayscale value as the grayscale value decreases.

According to some example embodiments, the gamma voltages may have a linear relationship with the first output data value.

According to some example embodiments, the first input data value and the first output data value may be located on a grayscale-voltage curve, a differential value of the grayscale-voltage curve may have a constant value in a first section, and may be represented by a linear equation in a second section, and input data values corresponding to the first section may be greater than input data values corresponding to the second section.

According to some example embodiments, the differential value may be represented by a quadratic equation in a third section, and input data values corresponding to the third section may be less than the input data values corresponding to the second section.

According to some example embodiments, a reference differential value of a representative grayscale value may be determined in an optical compensation process for setting a data voltage for the representative grayscale value, and the constant value and the linear equation may be set based on the differential value.

According to some example embodiments of the present disclosure, a display device may include a display panel configured to include a plurality of pixels, an interpolator configured to generate a first voltage value corresponding to an input data value using a preset gamma lookup table, a gamma compensator configured to, based on a dimming value, select at least one of a plurality of preset dimming lookup tables, correct the first voltage value based on the at least one dimming lookup table, and then calculate a first output data value, a gamma voltage generator configured to generate a plurality of gamma voltages having a linear relationship, and a data driver configured to select a first gamma voltage from among the gamma voltages based on the first output data value, and provide the first gamma voltage, as a data voltage, to the display panel.

According to some example embodiments, each of the dimming lookup tables may include gamma correction values that are set according to each of representative grayscale values, and the second gamma compensator may select a first dimming lookup table and a second dimming lookup table from among the dimming lookup tables based on the dimming value, generates an interpolated lookup table by interpolating gamma correction values included in the first dimming lookup table and gamma correction values included in the second dimming lookup table based on the dimming value, and additionally corrects the corrected voltage value using the interpolated lookup table.

According to some example embodiments, the gamma compensator may generate a gamma correction value for the first voltage value by interpolating correction values in the interpolated lookup table, and perform an addition operation on the first voltage value and the gamma correction value.

According to some example embodiments, the interpolator may determine a range of the first voltage value based on high-order R bits, among the first input data values, and may generate the first voltage value by interpolating the range of the first voltage value based on remaining bits of the first input data value, where R is a natural number less than P.

According to some example embodiments, the gamma lookup table may include first gamma data, and the first gamma data may include a minimum voltage value of the range of the first voltage value and a delta voltage value, and the delta voltage value may be a difference between a maximum voltage value of the range of the first voltage value and the minimum voltage value.

According to some example embodiments, the interpolator may interpolate the delta voltage value of the first gamma data based on the remaining bits of the first corrected data value.

DETAILED DESCRIPTION

Figure 1:
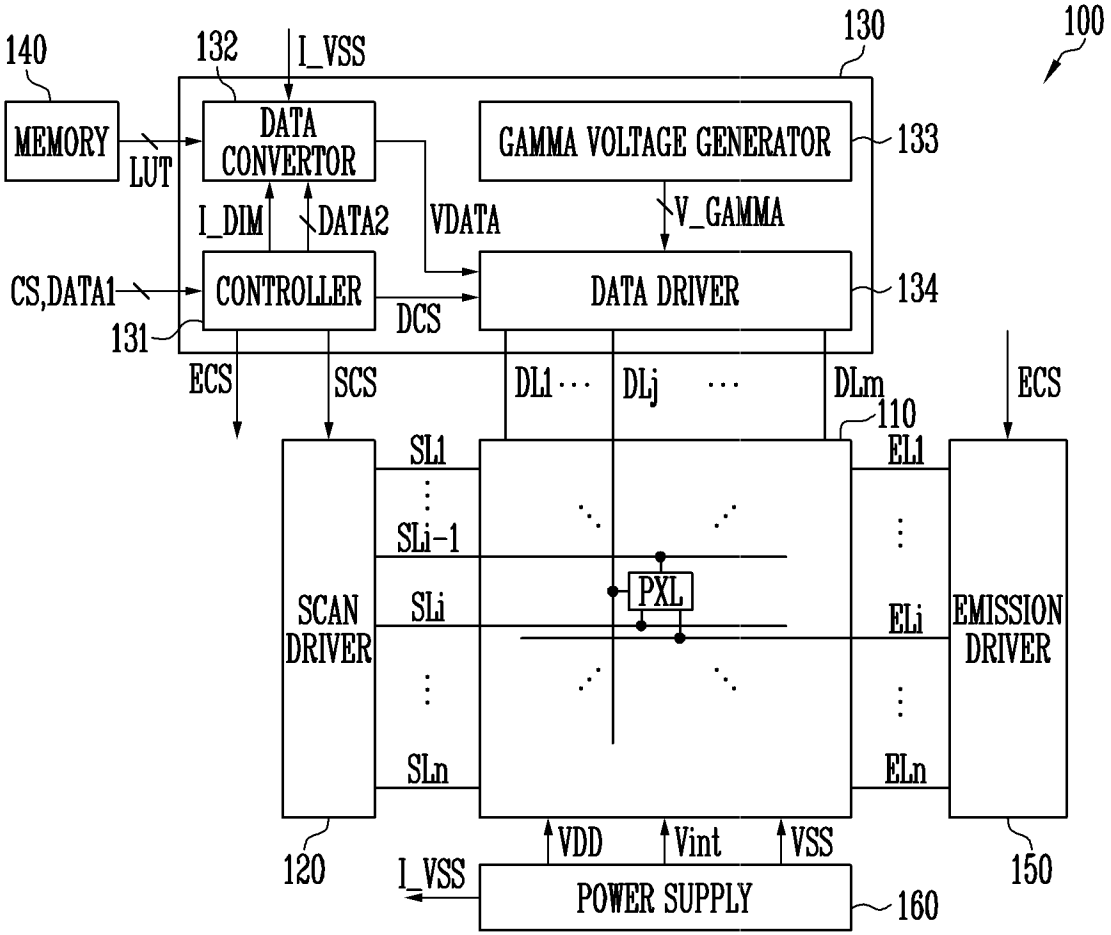
FIG. 1 is a block diagram illustrating a display device according to some example embodiments of the present disclosure.

Reference will now be made in more detail to aspects of various example embodiments of the present disclosure, specific examples of which are illustrated in the accompanying drawings and described below, because the embodiments of the present disclosure can be variously modified in many different forms. However, embodiments according to the present disclosure may be modified and practiced in various forms rather than being limited by the following embodiments.

Some elements which are not directly related to the features of the present disclosure in the drawings may be omitted to more clearly explain aspects of embodiments according to the present disclosure. Further, the sizes, ratios, etc. of some elements in the drawings may be slightly exaggerated. It should be noted that the same reference numerals are used to designate the same or similar elements throughout the drawings, and thus repeated descriptions thereof may be omitted.

FIG. 1 is a block diagram illustrating a display device according to some example embodiments of the present disclosure.

Referring to FIG. 1, a display device 100 may include a display 110 (or a display panel), a scan driver 120 (or a scan driving circuit), a driver 130, a memory 140 (or a storage device), an emission driver 150 (or an emission driving circuit), and a power supply 160.

The display 110 may include scan lines SL1 to SLn (where n is a positive integer), data lines DL1 to DLm (where m is a positive integer), emission control lines EL1 to ELn, and pixels PXL. The pixels PXL may be arranged in areas (e.g., pixel areas) partitioned or defined by the scan lines SL1 to SLn, the data lines DL1 to DLm, and the emission control lines EL1 to ELn.

Each of the pixels PXL may be coupled to at least one of the scan lines SL1 to SLn, one of the data lines DL1 to DLm, and one of the emission control lines EL1 to ELn. For example, each pixel PXL may be coupled to a scan line SLi, a previous scan line SLi-1 adjacent to the scan line SLi, a data line DLj, a data line DLj, and an emission control line ELi (where each of i and j is a positive integer).

The pixel PXL may be initialized in response to a scan signal provided through the previous scan line SLi-1 (or a scan signal provided at a previous time point), may store or write a data signal (or a data voltage) provided through the data line DLj in response to a scan signal provided through the scan line SLi (or a scan signal provided at a current time point), or may emit light with brightness corresponding to the stored data signal in response to an emission control signal provided through the emission control line ELi. The pixel PXL will be described in more detail later with reference to FIG. 15.

The scan driver 120 may generate scan signals in response to a scan control signal SCS, and may sequentially provide the scan signals to the scan lines SL1 to SLn. Here, the scan control signal SCS may include an initiation signal (or a start pulse) and clock signals, and may be provided from the driver 130. For example, the scan driver 120 may include a shift register (or a stage) which sequentially generates and outputs scan signals corresponding to a pulse-shaped initiation signal using clock signals.

The scan driver 120 may be formed in the display 110 through the same or similar process as a process for forming pixels PXL, or may be implemented as a separate integrated circuit.

The emission driver 150 may generate emission control signals in response to an emission driving control signal ECS, and may sequentially or concurrently (e.g., simultaneously) provide the emission control signals to the emission control lines EL1 to ELn. Here, the emission driving control signal ECS may include an emission initiation signal, emission clock signals, etc., and may be provided from the driver 130. For example, the emission driver 150 may include a shift register which sequentially generates and outputs emission control signals corresponding to a pulse-shaped emission initiation signal using the emission clock signals.

The driver 130 may generate data signals based on input image data DATA1 and a control signal CS provided from an external device (e.g., a graphic processor).

The driver 130 may include a controller 131 (or a timing controller), a data converter 132, a gamma voltage generator 133, and a data driver 134. The controller 131, the data converter 132, the gamma voltage generator 133, and the data driver 134 may be implemented in a single integrated circuit (IC), and may be mounted on a flexible circuit board coupled to the display 110. However, this is only for illustrative purposes, and embodiments according to the present disclosure are not limited thereto. For example, the controller 131 may be implemented as a single IC including the data converter 132, and the data driver 134 may be implemented as an IC independent of the controller 131.

The controller 131 may receive the input image data DATA1 and the control signal CS from an external device, generate the scan control signal SCS and a data control signal DCS in response to the control signal CS, and generate image data DATA2 by converting the input image data DATA1. Here, the control signal CS may include a vertical synchronization signal, a horizontal synchronization signal, a clock signal, etc. For example, the controller 131 may convert RGB-format input image data DATA1 into RGBG-format image data DATA2 conforming to a pixel array in the display 110.

The data converter 132 may convert an input grayscale value included in the image data DATA2 into a voltage value VDATA (or a data value in a voltage domain) using a lookup table LUT (or a gamma lookup table). Here, the lookup table LUT may include the voltage value VDATA corresponding to the input grayscale value, and the LUT may be provided from the memory 140 to the data converter 132. The voltage value VDATA may include information (e.g., selection information) about one of gamma voltages V_GAMMA generated by the gamma voltage generator 133, and the relationship between the input grayscale value and the voltage value VDATA may correspond to or match a 2.2 gamma curve. The voltage value VDATA will be described later with reference to FIGS. 3 and 4.

According to some example embodiments, the data converter 132 may convert the input grayscale value based on supply voltage information I_VSS. Here, the supply voltage information I_VSS may indicate the voltage level of a supply voltage (e.g., second supply voltage VSS) supplied to the display 110, and may be provided from the power supply 160. For reference, the display device 100 may decrease the magnitude of the second supply voltage VSS as the target brightness (or target brightness level) of an image displayed on the display device 100 decreases in order to reduce power consumption, and may vary the input grayscale value in accordance with a change in the target brightness and a change in the second supply voltage VSS. For example, the data converter 132 may generate a corrected data value (or a corrected grayscale value) by decreasing the input grayscale value based on the supply voltage information I_VSS. Here, the data converter 132 may convert the corrected data value into the voltage value VDATA using the lookup table LUT.

According to some example embodiments, the data converter 132 may compensate for the voltage value VDATA based on a dimming value I_DIM (or dimming information). Here, the dimming value I_DIM may indicate the target brightness level of the display device 100. The dimming value I_DIM may be provided from the controller 131.

For reference, the maximum brightness of the display device 100 (or an image displayed on the display device 100) may decrease depending on the dimming value I_DIM, and thus brightness error (or a brightness error rate) may relatively increase. Therefore, when the dimming value I_DIM is less than or equal to a reference dimming value (e.g., when the maximum brightness of the display device 100 is less than or equal to 100 nits), the data converter 132 may correct the voltage value VDATA using the lookup table LUT (or the dimming lookup table).

The gamma voltage generator 133 may generate gamma voltages V_GAMMA having a mutual linear relationship therebetween. For example, the gamma voltage generator 133 may include a resistor string and gamma buffers which transfer reference gamma voltages to taps (or tap points) of the resistor string. The gamma voltage generator 133 may be implemented as a typical analog gamma integrated circuit, and thus a detailed configuration of the gamma voltage generator 133 will be omitted.

The data driver 134 may generate data signals based on the data control signal DCS provided from the controller 131, the voltage value VDATA provided from the data converter 132, and the gamma voltages V_GAMMA provided from the gamma voltage generator 133, and may provide the data signals to the display 110 (or the pixels PXL). Here, the data control signal DCS may be a signal for controlling the operation of the data driver 134, and may include a load signal (or a data enable signal) or the like for indicating the output of a valid data signal.

For example, the data driver 134 may be configured to include a shift register, a latch, a decoder, an output buffer, etc. Based on the data control signal DCS, the data driver 134 may sequentially provide the voltage value VDATA to the shift register and the latch or temporarily store the voltage value VDATA in the shift register and the latch, may select a gamma voltage corresponding to the voltage value VDATA from among the gamma voltages V_GAMMA through the decoder, and may output the selected gamma voltage as a data signal (or a data voltage) to the corresponding data line through the output buffer.

The memory 140 may store the lookup table LUT. For example, the memory 140 may be implemented as a flash memory, may be mounted on a flexible circuit board on which the driver 130 is mounted, and may then be coupled to the driver 130 (e.g., the data converter 132).

According to some example embodiments, the lookup table LUT may include a gamma lookup table and a dimming lookup table. The gamma lookup table and the dimming lookup table will be described in more detail later with reference to FIGS. 3 to 5.

The power supply 160 may supply first and second supply voltages VDD and VSS to the display 110. Here, the first and second supply voltages VDD and VSS may be voltages required for the operation of the pixel PXL, wherein the first supply voltage VDD may have a voltage level higher than that of the second supply voltage VSS. In addition, the display 110 may be provided with an initialization supply voltage Vint. The first and second supply voltages VDD and VSS and the initialization supply voltage Vint may be provided from a separate power supply to the display 110.

According to some example embodiments, the power supply 160 may vary the voltage level of the second supply voltage VSS.

According to some example embodiments, the power supply 160 may generate supply voltage information I_VSS by measuring the voltage level of the second supply voltage VSS. For example, the power supply 160 may generate the supply voltage information I_VSS by measuring a voltage at an output terminal through which the second supply voltage VSS is output. The supply voltage information I_VSS may be provided to the driver 130 (e.g., the data converter 132 of the driver 130).

As described above with reference to FIG. 1, the display device 100 (e.g., the data converter 132 of the driver 130) may convert the input grayscale value into the voltage value VDATA on a gamma curve (e.g., a 2.2 gamma curve) using a lookup table LUT, and may output a gamma voltage corresponding to the voltage value VDATA, among the gamma voltages V_GAMMA having a mutual linear relationship therebetween, as a data signal (or a data voltage). That is, the display device 100 may use a scheme which converts an input grayscale value into a voltage value VDATA (or a scheme which outputs a gamma voltage corresponding to the voltage value VDATA, among linear gamma voltages V_GAMMA, as a data signal) using the lookup table LUT (or the gamma lookup table) including relationships (e.g., set or predetermined relationships) between input grayscale values and voltage values (e.g., preset or predetermined input grayscale values and voltage values) depending on the gamma curve (e.g., the 2.2 gamma curve), instead of a scheme for generating gamma voltages corresponding to the gamma curve (e.g., the 2.2 gamma curve).

In addition, the display device 100 may compensate for the voltage value VDATA using the lookup table LUT (or the dimming lookup table) when the dimming value I_DIM is less than or equal to the reference dimming value. Therefore, the brightness error (e.g., the difference between a target or desired brightness and an actual brightness) of an image displayed on the display device 100 may decrease.

Figure 2:
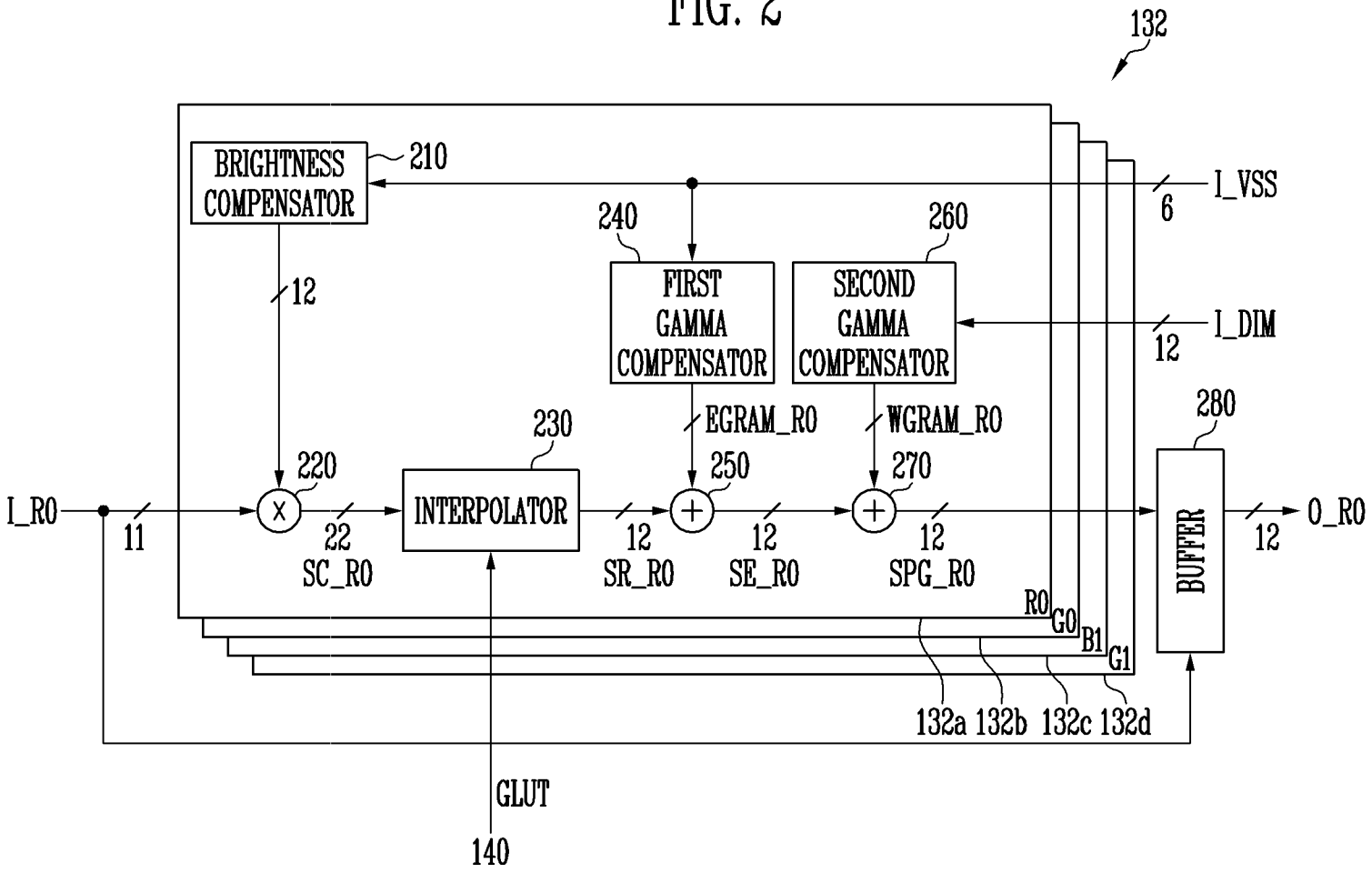
FIG. 2 is a block diagram illustrating an example of a data converter included in the display device of FIG. 1.

FIG. 2 is a block diagram illustrating an example of the data converter included in the display device of FIG. 1 according to some example embodiments.

Referring to FIG. 2, the data converter 132 may convert a first input grayscale value I_R0 (or an input data value) and output an output data value O_R0 (e.g., the voltage value VDATA described above with reference to FIG. 1).

The data converter 132 may include a brightness compensator 210, a first operating component 220, an interpolator 230 (or a voltage value calculator), a first gamma compensator 240, a second operating component 250, a second gamma compensator 260, a third operating component 270, and a buffer 280 (or a buffer register).

The brightness compensator 210, the first operating component 220, the interpolator 230, the first gamma compensator 240, the second operating component 250, the second gamma compensator 260, and the third operating component 270 may constitute a single data conversion block, wherein the data conversion block may be provided for each of pixels PXL (see, e.g., FIG. 1) (or each of sub-pixels) of individual unit pixels. For example, when a unit pixel includes a first pixel R0 for emitting light in a first color (e.g., a red color), a second pixel G0 for emitting light in a second color (e.g., a green color), a third pixel B1 for emitting light in a third color (e.g., a blue color), and a fourth pixel G1 for emitting light in a second color (e.g., the green color), that is, when the unit pixel includes first to fourth pixels R0, G0, B1, and G1 arranged in a PenTile form or arrangement, the data converter 132 may include a first data conversion block 132*a*, a second data conversion block 132*b*, a third data conversion block 132*c*, and a fourth data conversion block 132*d* for the first to fourth pixels R0, G0, B1, and G1.

Because the first to fourth data conversion blocks 132*a*, 132*b*, 132*c*, and 132*d* for the first to fourth pixels R0, G0, B1, and G1 are substantially identical or similar to each other, the first data conversion block 132*a* for the first pixel R0 will be described as a representative one of the first to fourth data conversion blocks 132*a*, 132*b*, 132*c*, and 132*d*.

The brightness compensator 210 may generate a data correction value (or a first data correction value for the first pixel R0) corresponding to supply voltage information I_VSS (or the voltage level of a second supply voltage VSS). Here, the data correction value may indicate the compensation rate of the first input grayscale value I_R0 depending on the second supply voltage VSS, the ratio of the current voltage level of the second supply voltage VSS to the reference voltage level of the second supply voltage VSS, etc. The data correction value may be calculated based on the supply voltage information I_VSS, or alternatively, a first data correction value corresponding to the supply voltage information I_VSS may be preset. As the magnitude of the second supply voltage VSS decreases, the data correction value may decrease.

The first data correction value may be represented by P bits (where P is a natural number), and P may be, for example, 12. Hereinafter, for convenience of description, it is assumed that P is 12, that is, the first data correction value has 12 bits. Similarly, the first input grayscale value I_R0 may be represented by Q bits (where Q is a natural number). Hereinafter, it is assumed that Q is 11, that is, the input grayscale value I_R0 has 11 bits and that an output data value O_R0 has P bits, that is, 12 bits.

The first operating component 220 may perform a multiply operation on the first input grayscale value I_R0 and the data correction value, and may then output a first corrected data value SC_R0. The first operating component 220 may be implemented as a logical operation circuit. The first operating component 220 may also be included in the brightness compensator 210. By the multiply operation on the 11-bit first input grayscale value I_R0 and the 12-bit data correction value, the first corrected data value SC_R0 may be represented by 22 bits (i.e., P+Q−1 bits).

The interpolator 230 may calculate a first voltage value SR_R0 corresponding to the first corrected data value SC_R0 using a preset gamma lookup table GLUT. Here, the gamma lookup table GLUT may, for example, be included in the lookup table LUT, described above with reference to FIG. 1, and may be provided from the memory 140 to the interpolator 230.

According to some example embodiments, the interpolator 230 may determine the range of the first voltage value based on high-order (or upper) R bits (where R is a natural number less than P) of the first corrected data value SC_R0, and may generate the first voltage value SR_R0 by interpolating the range of the first voltage value based on low-order (or lower) bits (e.g., low-order P+Q−1−R bits) of the first corrected data value SC_R0 indicating the remaining bits of the first corrected data value SC_R0. For example, the interpolator 230 may determine the range of the first voltage value based on high-order 8 bits of the first corrected data value SC_R0, and may generate the first voltage value SR_R0 by interpolating the range of the first voltage value based on the low-order 14 bits of the first corrected data value SC_R0.

For example, the interpolator 230 may select specific gamma lookup table GLUT data (or first gamma data) from among pieces of gamma lookup table data (or gamma lookup table data values, hereinafter referred to as "GLUT data") included in the gamma lookup table GLUT based on the high-order 8 bits of the first corrected data value SC_R0. That is, the high-order 8 bits of the first corrected data value SC_R0 may indicate the address of the specific GLUT data.

Meanwhile, the GLUT data included in the gamma lookup table GLUT may include a minimum voltage value of the range of the first voltage value and a delta voltage value, wherein the delta voltage value may be the difference between the maximum voltage value and the minimum voltage value of the range of the first voltage value. For example, the GLUT data may include 21 bits, and the high-order 12 bits (e.g., 12 of the 21 bits, or the first 12 of the 21 bits) of the GLUT data may indicate the minimum voltage (or a reference voltage, e.g., an n-th reference voltage, where n is the address of the GLUT data) of the first voltage value range, and the low-order 9 bits (e.g., 9 of the 21 bits, or the last 9 of the 21 bits) of the GLUT data may indicate the delta voltage value (e.g., n+1-th reference voltage−n-th reference voltage). However, because there is a 256-th reference voltage, a 255-th delta voltage value may be set to '0'. Because the GLUT data includes the delta voltage value, at least one of operations included in the operation process for calculating the voltage value (e.g., the operation of loading a value corresponding to an n+1-th reference voltage and calculating a delta voltage value so as to interpolate the range of the first voltage value) may be omitted.

Figure 3:
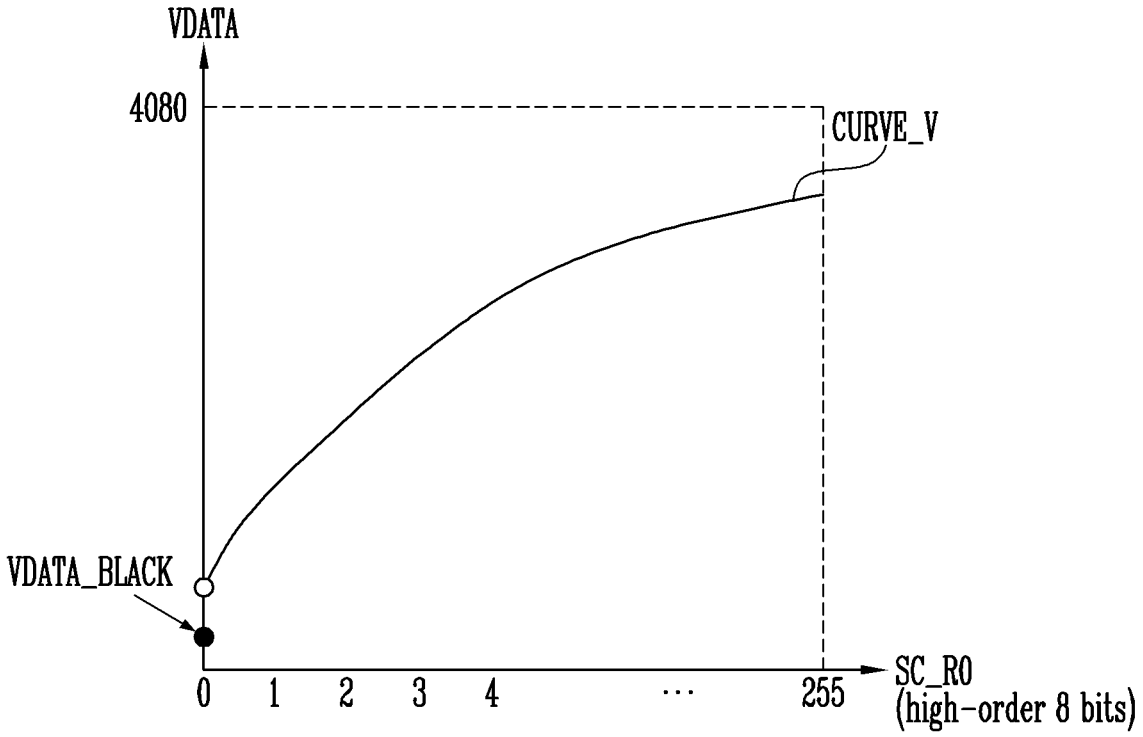
FIG. 3 is a diagram illustrating relationships between input grayscale values, provided to an interpolator included in the data converter of FIG. 2, and voltage values.
Figure 4:
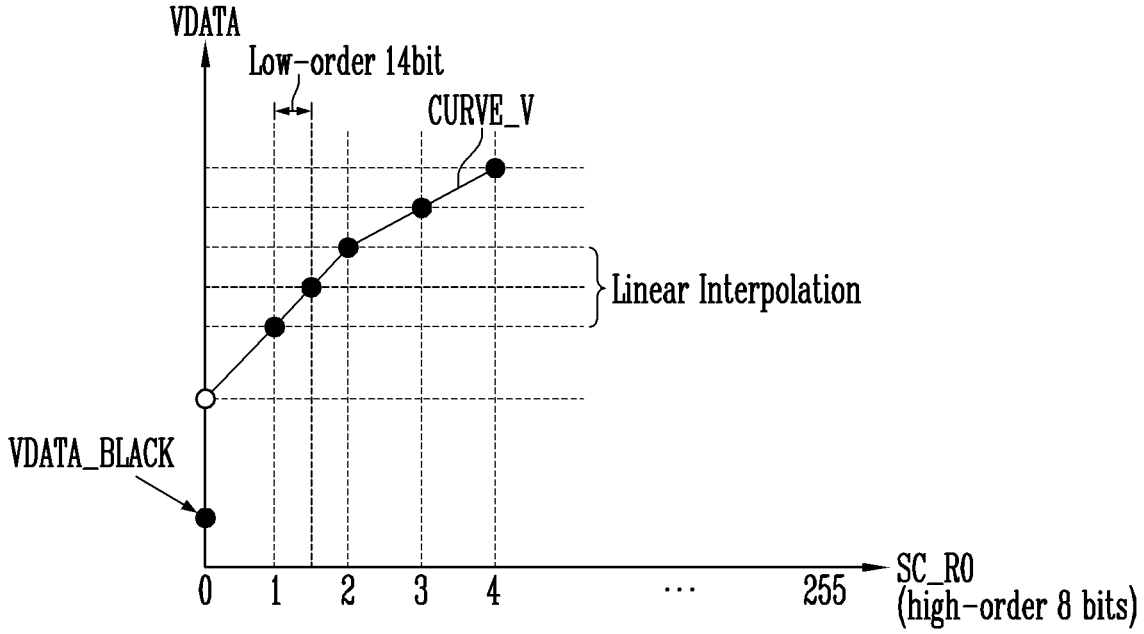
FIG. 4 is a diagram for explaining an operation of the interpolator included in the data converter of FIG. 2.

In order to describe a detailed operation of the interpolator 230, FIGS. 3 and 4 may be referred to. After the interpolator 230 is described with reference to FIGS. 3 and 4, the first gamma compensator 240 or the like will be subsequently described.

FIG. 3 is a diagram illustrating relationships between input grayscale values, provided to an interpolator included in the data converter of FIG. 2, and voltage values. FIG. 4 is a diagram for explaining an operation of the interpolator included in the data converter of FIG. 2.

Referring to FIGS. 3 and 4, a first voltage curve CURVE_V may indicate the relationship between high-order 8 bits of a first corrected data value SC_R0 and voltage values VDATA. The first voltage curve CURVE_V may be preset in accordance with an ideal 2.2 gamma curve. A configuration for setting the first voltage curve CURVE_V will be described in detail later with reference to FIGS. 10 to 12.

For example, when the high-order 8 bits of the first corrected data value SC_R0 have a value of '1', the interpolator 230 may set the range (or section) of the voltage value VDATA corresponding to a section between a value of '1' and a value of '2' as the range of the first voltage value, and may set the voltage value VDATA corresponding to the value of '1' as a minimum voltage value.

Thereafter, the interpolator 230 may calculate the first voltage value SR_R0 by interpolating (or linearly interpolating) the range of the first voltage value (i.e., the delta voltage value of GLUT data) based on the low-order 14 bits of the first corrected data value SC_R0.

According to some example embodiments, the gamma lookup table GLUT may further include a reference voltage value VDATA_BLACK (or a black voltage value) deviating from the first voltage curve CURVE_V. The reference voltage value VDATA_BLACK may correspond to grayscale 0, may indicate a data voltage provided to the pixel PXL (see FIG. 1) indicating black, or may be a voltage value corresponding to the data voltage. The reference voltage value VDATA_BLACK (and the last reference voltage, i.e., a 255-th reference voltage) may be used as a compensation reference by the first gamma compensator 240, which will be described in more detail later, and thus the reference voltage value VDATA_BLACK may always be output from the interpolator 230.

According to some example embodiments, the display device 100 (see, e.g., FIG. 1) may be driven in a first mode (or a normal mode) or a second mode (or a low persistence mode). Here, the first mode may be a normal mode in which an image is displayed on the entire area of the display 110 (see, e.g., FIG. 1), and the second mode may be a mode in which an image is displayed only on a partial area of the display 110 (see, e.g., FIG. 1).

In the first mode, the interpolator 230 may determine the range of the first voltage value based on the first corrected data value SC_R0, and may output the first voltage value SR_R0 by interpolating the range of the first voltage value (or the delta voltage value). Meanwhile, in the second mode, the interpolator 230 may output the minimum voltage value of the range of the first voltage value as the first voltage value SR_R0 based on the first corrected data value SC_R0. That is, in the second mode, the interpolator 230 may output only the minimum voltage of the GLUT data as the first voltage value SR_R0 without performing an interpolation operation on the delta voltage value of the GLUT data. In this case, in the second mode, the power consumption of the display device 100 (see FIG. 1) may be further decreased.

Referring back to FIG. 2, the first gamma compensator 240 may calculate a first voltage correction value EGRAM_R0 based on supply voltage information I_VSS. Here, the first voltage correction value EGRAM_R0 may be a value for compensating for the first voltage value SR_R0 (e.g., a value partially deviating from a 2.2 gamma curve) depending on the change in the second supply voltage VSS. The first voltage correction value EGRAM_R0 may be calculated from the supply voltage information I_VSS or, alternatively, the first voltage correction value EGRAM_R0 corresponding to the supply voltage information I_VSS may be preset.

The second operating component 250 may generate a first corrected voltage value SE_R0 by performing an addition operation on the first voltage value SR_R0 and the first voltage correction value EGRAM_R0. The second operating component 250 may also be included in the first gamma compensator 240.

When the first corrected voltage value SE_R0 is greater than the maximum voltage value, the second operating component 250 may output the maximum voltage value as the first corrected voltage value SE_R0. When the first corrected voltage value SE_R0 is greater than a value of 4080, the second operating component 250 may output 4080 as the first corrected voltage value SE_R0. Therefore, instances of an overflow of the first corrected voltage value SE_R0 may be prevented or reduced.

When the dimming value I_DIM is less than or equal to a reference dimming value (e.g., 100 nits), the second gamma compensator 260 may select at least one dimming lookup table from among a plurality of preset dimming lookup tables based on the dimming value I_DIM, and may generate a first dimming correction value WGRAM_R0 based on the selected at least one dimming lookup table. Here, the dimming lookup table may be included in the lookup table LUT, described above with reference to FIG. 1, and may be provided from the memory 140 to the interpolator 230, but embodiments according to the present disclosure are not limited thereto.

Meanwhile, when the dimming value I_DIM is greater than the reference dimming value or when the display device 100 is driven in a second mode (or a low-persistence mode), the second gamma compensator 260 may not be operated.

As described above with reference to FIG. 1, because brightness error increases as the dimming value I_DIM decreases, the second gamma compensator 260 may generate a first dimming correction value WGRAM_R0 for additionally compensating for the first corrected voltage value SE_R0 using the dimming lookup table when the dimming value I_DIM is less than or equal to the reference dimming value.

Figure 5:
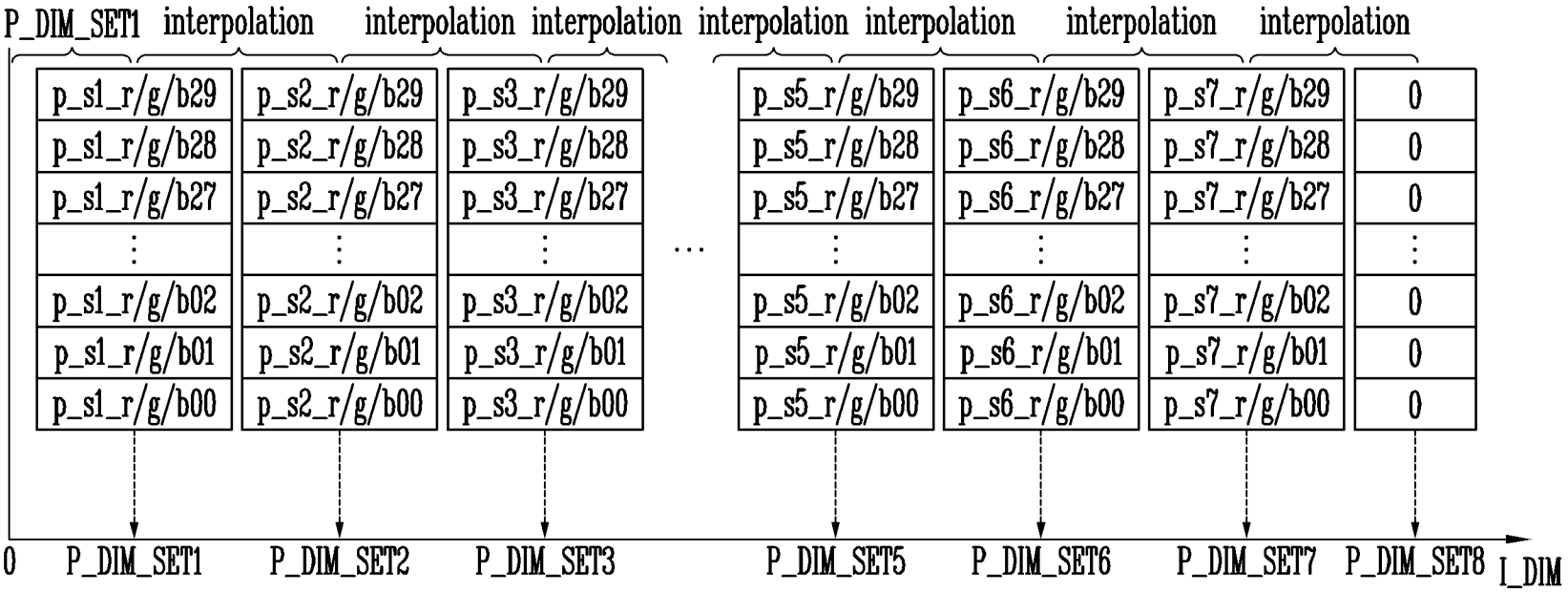
FIG. 5 is a diagram illustrating an example of a dimming lookup table used in a second gamma compensator included in the data converter of FIG. 2.
Figure 6:
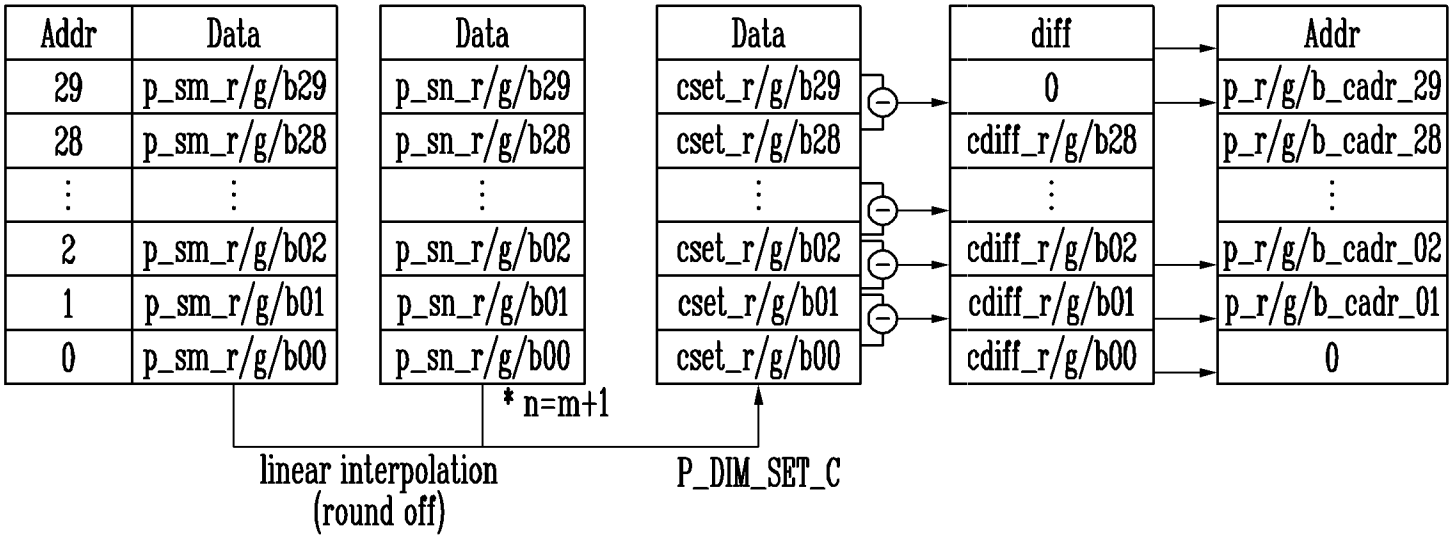
FIG. 6 is a diagram for explaining an operation of the second gamma compensator included in the data converter of FIG. 2.

In order to describe the operation of the dimming lookup table and the second gamma compensator 260, FIGS. 5 and 6 will be referred to.

FIG. 5 is a diagram illustrating an example of a dimming lookup table used in the second gamma compensator included in the data converter of FIG. 2. FIG. 6 is a diagram for explaining an operation of the second gamma compensator included in the data converter of FIG. 2.

Referring to FIG. 5, dimming lookup tables P_DIM_SET1 to P_DIM_SET8 may be set for specific dimming values (or specific brightness values). For example, a first dimming lookup table P_DIM_SET1 may be set in accordance with a brightness of 10 nits, a second dimming lookup table P_DIM_SET2 may be set in accordance with a brightness of 20 nits, an eighth dimming lookup table P_DIM_SET8 may be set in accordance with a brightness of 100 nits, and third to seventh dimming lookup tables P_DIM_ SET3 to P_DIM_SET7 may be set at intervals of a brightness of 20 nits.

Meanwhile, although an example in which eight dimming lookup tables P_DIM_SET1 to P_DIM_SET8 are set at intervals of a brightness of 10 nits or 20 nits is illustrated in FIG. 5, this is merely an example, and the dimming lookup tables P_DIM_SET1 to P_DIM_SET8 are not limited thereto. For example, the number of dimming lookup tables P_DIM_SET1 to P_DIM_SET8 may be less than or equal to 7, or may be equal to or greater than 9, and the dimming lookup tables P_DIM_SET1 to P_DIM_SET8 may be set at intervals of a brightness of 10 nits or less or a brightness of 20 nits or more.

The dimming lookup tables P_DIM_SET1 to P_DIM_SET8 may include gamma correction values that are set in accordance with representative grayscale values, respectively. Here, the representative grayscale values may be randomly set among all input grayscale values falling within the grayscale range of a first input grayscale value I_R0, and the number of representative grayscale values may be, for example, 30. The number of representative grayscale values may be twice or more as large as the number of taps (e.g., 10) included in the gamma voltage generator (see, e.g., FIG. 1). The reason for this is to more accurately compensate for a specific brightness section during which, when the display device 100 is driven in a dimming driving scheme, brightness sag (i.e., a phenomenon in which light is emitted with brightness lower than target brightness) occurs.

In the first dimming lookup table P_DIM_SET1, a first gamma correction value p_s1_r/g/b00 may be a gamma correction value for the first representative grayscale value, and may include the gamma correction value for the first pixel R0, the gamma correction value for the second pixel G0, and the gamma correction value for the third pixel B1, which are described above with reference to FIG. 2. Similarly, a second gamma correction value p_s1_r/g/b01 may be a gamma correction value for the second representative grayscale value. That is, a k-th gamma correction value p_s1_r/g/bk (where k is an integer greater than 2 and less than 30) may be a gamma correction value for a k-th representative grayscale value.

Similarly, in a second dimming lookup table P_DIM_SET2, a first gamma correction value p_s2_r/g/b00 may be a gamma correction value for the first representative grayscale value, and a second gamma correction value p_s2_r/g/b01 may be a gamma correction value for the second representative grayscale value. That is, a k-th gamma correction value p_s2_r/g/bk may be a gamma correction value for a k-th representative grayscale value.

Meanwhile, gamma correction values included in an eighth dimming lookup table P_DIM_SET8 may be '0'. The eighth dimming lookup table P_DIM_SET8 may be generated for an interpolation operation for the second gamma compensator 260.

When the dimming value I_DIM corresponds to specific brightness values (i.e., one of brightness values at which the dimming lookup tables are set), a dimming lookup table corresponding to the specific brightness may be selected. However, when the dimming value I_DIM is different from the specific brightness values, the second gamma compensator 260 may select two dimming lookup tables.

Referring to FIG. 6, the second gamma compensator 260 may select two adjacent dimming lookup tables (e.g., an m-th dimming lookup table and an n-th dimming lookup table, where n=m+1) based on the dimming value I_DIM, and may generate an interpolated dimming lookup table P_DIM_SET_C (or an interpolated lookup table) by interpolating gamma voltages (or gamma voltages mutually corresponding to each other) included in the two dimming lookup tables.

For example, when the dimming value I_DIM corresponds to 15 nits, the second gamma compensator 260 may select the first dimming lookup table P_DIM_SET1 corresponding to 10 nits and the second dimming lookup table P_DIM_SET2 corresponding to 20 nits, and may generate a first gamma correction value cset_r/g/b00 of an interpolated dimming lookup table P_DIM_SET_C by interpolating the first gamma correction value p_s1_r/g/b00 of the first dimming lookup table P_DIM_SET1 and the first gamma correction value p_s2_r/g/b00 of the second dimming lookup table P_DIM_SET2. In the second gamma compensator 260, the first gamma correction value cset_r/g/b00 of the interpolated dimming lookup table P_DIM_SET_C may have the same magnitude as the magnitude (e.g., 12 bits) of the first gamma correction value p_s1_r/g/b00 of the first dimming lookup table P_DIM_SET1 by rounding off the first gamma correction value cset_r/g/b00.

Similarly, the second gamma compensator 260 may generate a second gamma correction value cset_r/g/b01 of the interpolated dimming lookup table P_DIM_SET_C by interpolating the second gamma correction value p_s1_r/g/b01 of the first dimming lookup table P_DIM_SET1 and the second gamma correction value p_s2_r/g/b01 of the second dimming lookup table P_DIM_SET2, and may generate the interpolated dimming lookup table P_DIM_SET_C.

Meanwhile, when the dimming value I_DIM is less than the minimum dimming value (e.g., when the dimming value I_DIM is less than 10 nits), the second gamma compensator 260 may select a first dimming lookup table P_DIM_SET1.

For reference, when the dimming value I_DIM changes, a task for selecting at least one of the dimming lookup tables P_DIM_SET1 to P_DIM_SET8 and generating the interpolated dimming lookup table P_DIM_SET_C may be performed.

According to some example embodiments, the second gamma compensator 260 may calculate a first dimming correction value WGRAM_R0 within the entire range by interpolating the gamma correction values cset_r/g/b00 to cset_r/g/b29 of the interpolated dimming lookup table P_DIM_SET_C.

According to some example embodiments, the second gamma compensator 260 may calculate differential gamma correction values by performing a subtraction operation between adjacent gamma correction values in the interpolated dimming lookup table P_DIM_SET_C. For example, the second gamma compensator 260 may calculate a first differential gamma correction value cdiff_r/g/b00 by performing a differential operation on the second gamma correction value cset_r/g/b01 and the first gamma correction value cset_r/g/b00.

The gamma correction value and the differential gamma correction value, which mutually correspond to each other, may have one address Addr. For example, the first gamma correction value set_r/g/b00 and the first differential gamma correction value cdiff_r/g/b00 may have a first address value of 0, and the second gamma correction value cset_r/g/b01 and the second differential gamma correction value diff_r/g/b01 may have a second address value of p_r/g/b_cadr_01.

Meanwhile, the input grayscale value I_R0 provided to the data converter 132 may be used as an address Addr for the gamma correction value and the differential gamma correction value included in the interpolated dimming lookup table P_DIM_SET_C.

According to some example embodiments, the second gamma compensator 260 may generate a first dimming correction value WGRAM_R0 using the following Equation (1):

$$WGRAM_R0 = cset_rN + cdiff_rN * (I_R0 - p_r_card_N)/(p_r_card_N+1 - p_r_card_N) \quad (1)$$

Here, N is a natural number, cset_rN is an N-th gamma correction value, and cdiff_rN is an N-th differential gamma correction value.

For example, when the address depending on the first input grayscale value I_R0 is greater than a second address value p_r/g/b_cadr_01 and is less than a third address value p_r/g/b_cadr_02, a second gamma correction value cset_r/g/b01 and a second differential gamma correction value cdiff_r/g/b01 corresponding to the second address value p_r/g/b_cadr_01 may be used to generate a first dimming correction value WGRAM_R0. In this case, the second gamma compensator 260 may calculate the first dimming correction value WGRAM_R0 for the first corrected voltage value SE_R0 by applying the first input grayscale value I_R0, the second address value p_r/g/b_cadr_01, the third address value p_r/g/b_cadr_02, the second gamma correction value cset_r/g/b01, and the second differential gamma correction value cdiff_r/g/b01 to Equation (1).

The third operating component 270 may generate a first output voltage value SPG_R0 by performing an addition operation on the first corrected voltage value SE_R0 and the first dimming correction value WGRAM_R0. The third operating component 270 may be included in the second gamma compensator 260.

When the first output voltage value SPG_R0 is greater than the maximum voltage value, the third operating component 270 may output the maximum voltage value as the first output voltage SPG_R0. For example, when the first output voltage value SPG_R0 is greater than a value of 4080, the third operating component 270 may output 4080 as the first output voltage value SPG_R0. Therefore, the overflow of the first output voltage value SPG_R0 may be prevented.

The buffer 280 may output the first output voltage value SPG_R0 as an output data value O_R0 (or as the voltage value VDATA described above with reference to FIG. 1). For example, the output data value O_R0 may also include the first output voltage value SPG_R0 of the first data conversion block 132*a*, the second output voltage value of the second data conversion block 132*b*, the second output voltage value of the third data conversion block 132*c*, and the output voltage value of the fourth data conversion block 132*d*.

Meanwhile, the buffer 280 may directly receive the first input grayscale value I_R0. For example, when the operation of the data converter 132 is not required, the buffer 280 may output the first input grayscale value I_R0 as the output data value O_R0. That is, if necessary, the buffer 280 may bypass the input grayscale value I_R0.

As described above with reference to FIGS. 2 to 6, the data converter 132 may convert the input grayscale value into an output data value on a 2.2 gamma curve using a gamma lookup table GLUT. Further, when the dimming value I_DIM is less than or equal to the reference dimming value, the data converter 132 may additionally compensate for the output data value using the dimming lookup table. Therefore, brightness error of an image displayed on the display device 100 (i.e., the difference between the target brightness and the actual brightness) may be decreased.

Meanwhile, although an example in which the data converter 132 includes the brightness compensator 210 (and the first operating component 220) and the first gamma compensator 240 (and the second operating component 250) is illustrated in FIG. 2, the present disclosure is not limited thereto.

For example, when the power supply 160 (see FIG. 1) generates a second supply voltage VSS having a fixed voltage level, the data converter 132 may not include the brightness compensator 210 (and the first operating component 220) and the first gamma compensator 240 (and the second operating component 250). In this case, the first input grayscale value I_R0 may be directly provided to the interpolator 230, and the first voltage value SR_R0 generated by the interpolator 230 may be directly provided to the third operating component 270 (or the second gamma compensator 260).

Figure 7:
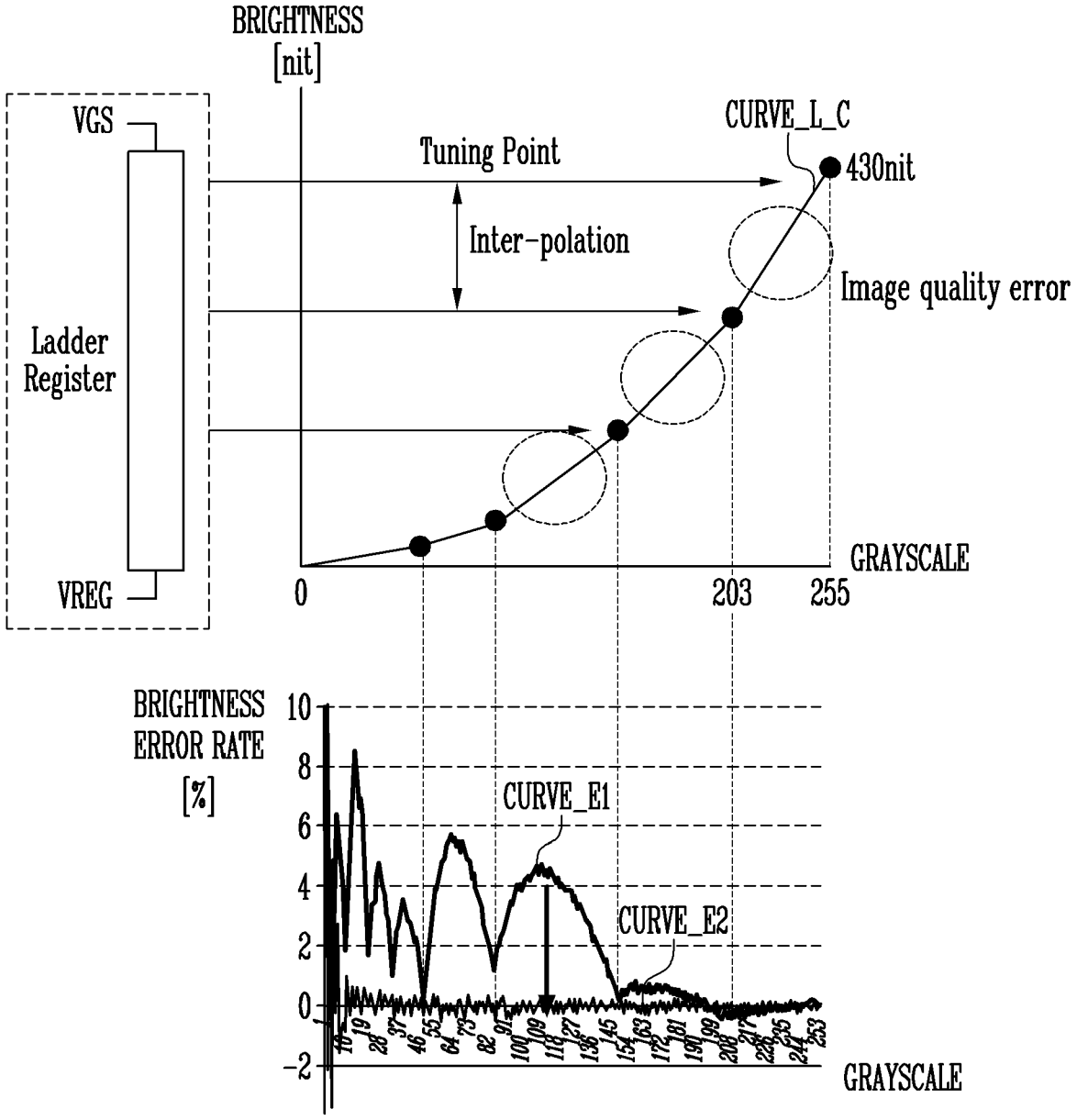
FIG. 7 is a diagram illustrating a comparative example of a brightness curve indicating brightness values for respective grayscale values of the display device of FIG. 1.
Figure 8:
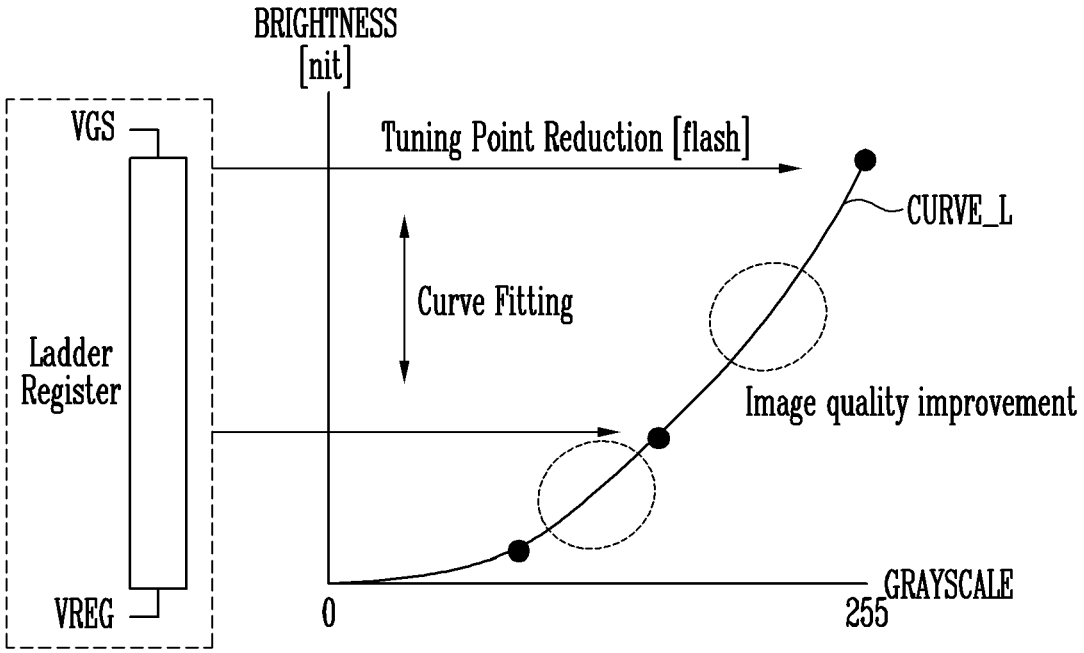
FIG. 8 is a diagram illustrating an example of a brightness curve of the display device of FIG. 1.

FIG. 7 is a diagram illustrating a comparative example of a brightness curve indicating brightness values for respective grayscale values of the display device of FIG. 1. FIG. 8 is a diagram illustrating an example of a brightness curve of the display device of FIG. 1.

First, referring to FIGS. 1 and 7, the gamma voltage generator according to the comparative example may generate gamma voltages corresponding to a 2.2 gamma curve by voltage-dividing reference voltages VGS and VREG through a ladder register.

In particular, the gamma voltage generator according to the comparative example may generate reference gamma voltages corresponding to some tap points (e.g., six tap points corresponding to a grayscale of 255, a grayscale of 203, etc.), and may generate gamma voltages by linearly interpolating the reference gamma voltages. In this case, because a comparative brightness curve CURVE_L_C of the display device depending on the gamma voltages linearly changes between the tap points, brightness error may occur with respect to the brightness curve depending on the ideal 2.2 gamma curve.

A first error curve CURVE_E1 indicates brightness errors for respective grayscale levels depending on the comparative brightness curve CURVE_L_C according to the comparative example. Depending on the first error curve CURVE_E1, brightness error at each gamma tap point approaches '0', but a brightness error of a maximum of 8% may occur in a direction farther away from the tap points. Such brightness error may appear as display quality error, and may be perceived by a user.

Meanwhile, referring to FIGS. 1, 7, and 8, the gamma voltage generator 133 according to embodiments of the present disclosure may generate gamma voltages by voltage-dividing reference voltages VGS and VREG through a ladder register, and the data converter 132 may convert the first input grayscale value I_R0 into an output data value O_R0 corresponding to the 2.2 gamma curve. That is, the gamma voltages may be fitted to the brightness curve CURVE_L corresponding to an ideal 2.2 gamma curve through the data converter 132 in a digital manner (i.e., curve fitting). In this case, the gamma voltage generator 133 may set the tap points regardless of inflection points on the 2.2 gamma curve, and thus the number of tap points may be reduced.

Referring back to FIG. 7, a second error curve CURVE_E2 indicates brightness errors for respective grayscale values depending on the brightness curve CURVE_L according to an embodiment of the present disclosure. Referring to the second error curve CURVE_E2, brightness errors in all grayscale sections may approach '0'. This may result in display quality improvement.

Hereinafter, a process for generating a gamma lookup table GLUT (see FIG. 2) (and GLUT data) will be described in more detail with reference to FIGS. 9 to 12.

Figure 9:
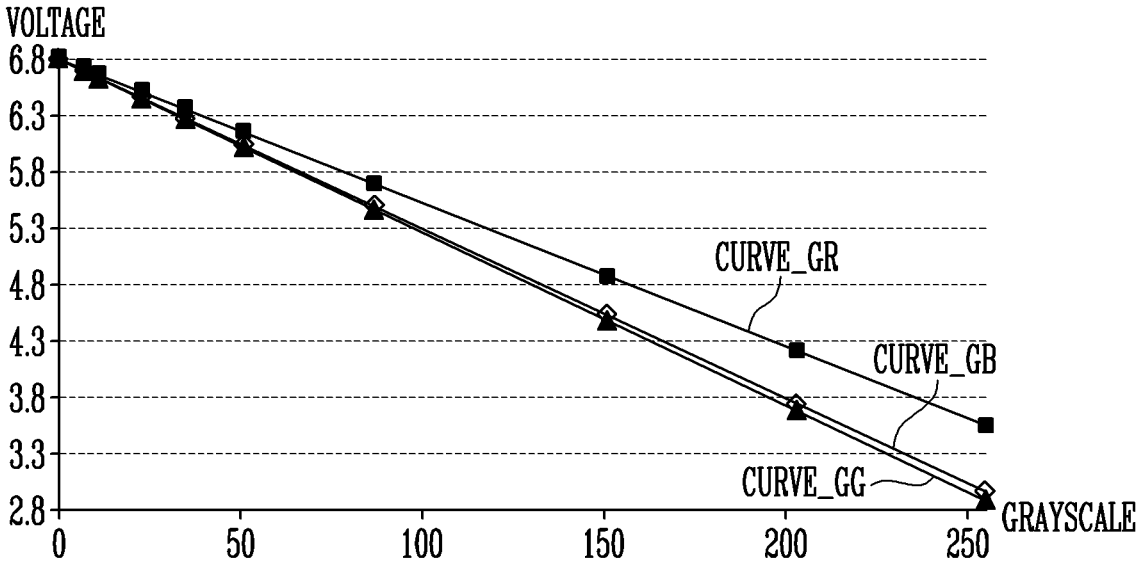
FIG. 9 is a diagram illustrating an example of gamma voltages generated by a gamma voltage generator included in the display device of FIG. 1.
Figure 10:
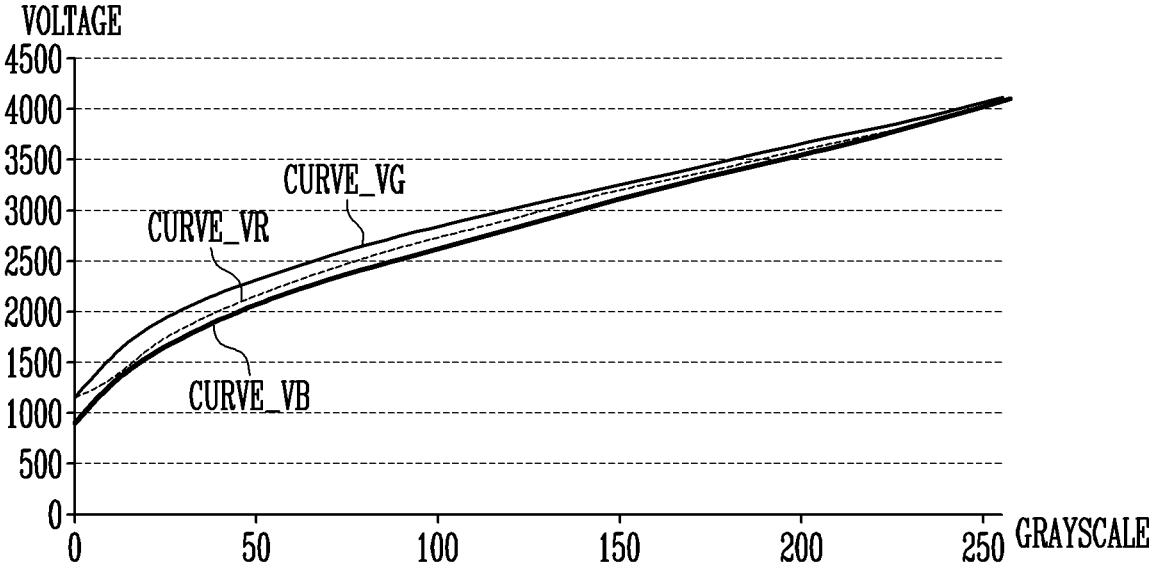
FIG. 10 is a diagram illustrating relationships between input grayscale values and voltage values acquired through optical compensation of the display device of FIG. 1.
Figure 11:
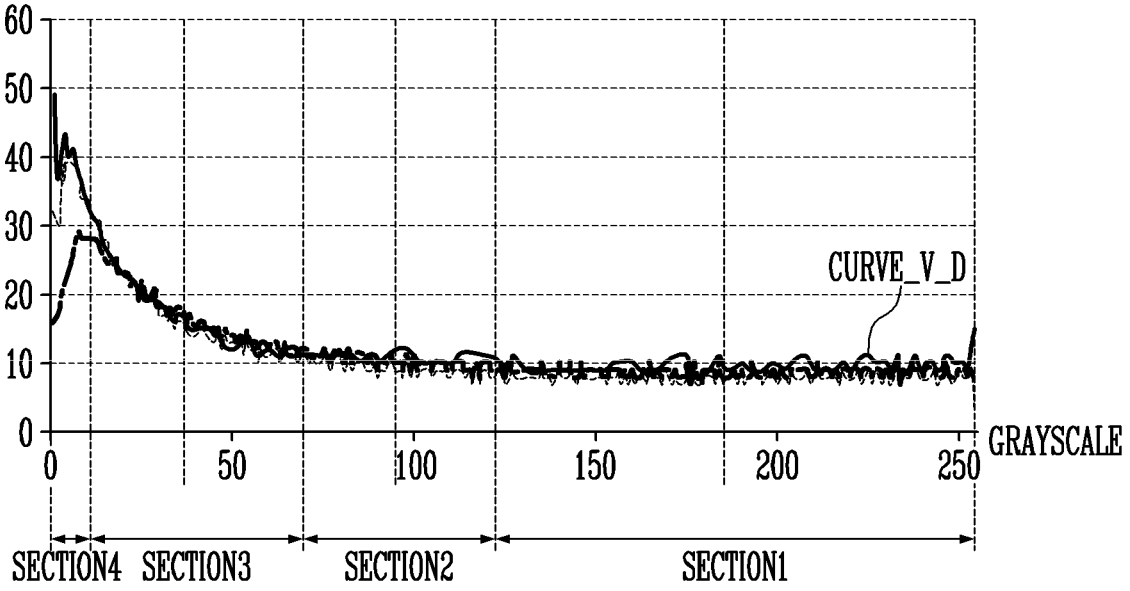
FIG. 11 is a diagram illustrating a graph obtained by performing first differentiation on the graph of FIG. 10.
Figure 12:
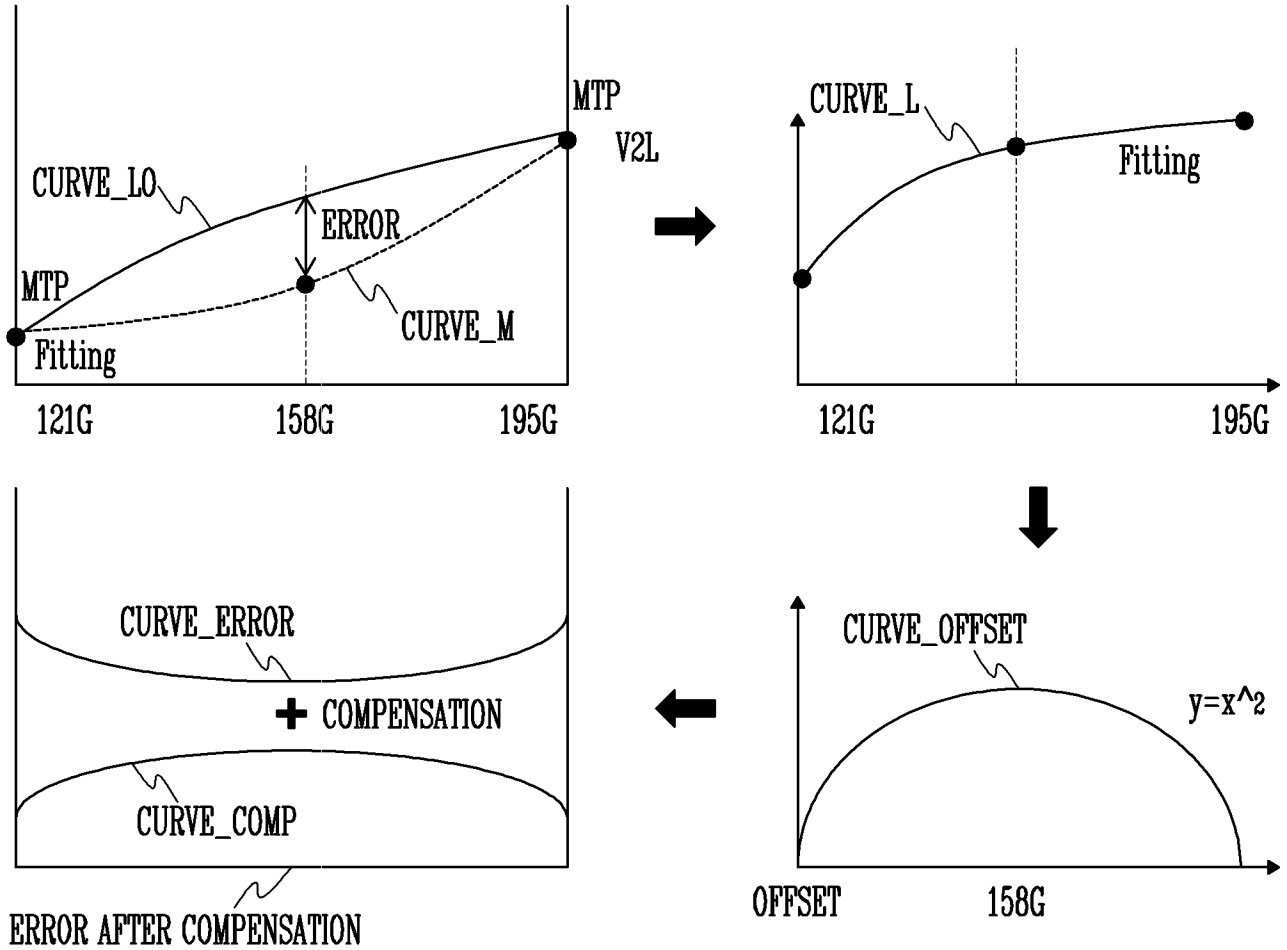
FIG. 12 is a diagram illustrating a process for additionally correcting the graph of FIG. 10.

FIG. 9 is a diagram illustrating an example of gamma voltages generated by the gamma voltage generator included in the display device of FIG. 1. FIG. 10 is a diagram illustrating relationships between input grayscale values and voltage values acquired through optical compensation of the display device of FIG. 1. FIG. 11 is a diagram illustrating a graph obtained by performing first differentiation on the graph of FIG. 10. FIG. 12 is a diagram illustrating a process for additionally correcting the graph of FIG. 10.

First, referring to FIGS. 1 and 9, a first gamma voltage curve CURVE_GR (or a first color gamma voltage curve) indicates first gamma voltages for respective grayscale levels as to a first pixel which emits light in a first color (or first color gamma voltages), a second gamma voltage curve CURVE_GG (or a second color gamma voltage curve) indicates second gamma voltages for respective grayscale levels as to a second pixel which emits light in a second color (or second color gamma voltages), and a third gamma voltage curve CURVE_GB (or a third color gamma voltage curve) indicates third gamma voltages for respective grayscale levels as to a third pixel which emits light in a third color (or third color gamma voltages).

Depending on the first gamma voltage curve CURVE_GR, the first gamma voltages may have a mutual linear relationship. That is, as the grayscale value increases, the first gamma voltages may linearly decrease. Similarly, depending on the second gamma voltage curve CURVE_GG, the second gamma voltages have a mutual linear relationship, and depending on the third gamma voltage curve CURVE_GB, third gamma voltages may have a mutual linear relationship.

That is, the gamma voltage generator 133 may generate the first gamma voltages, the second gamma voltages, and the third gamma voltages which have mutual linear relationships, regardless of the 2.2 gamma curve.

Referring to FIGS. 9 and 10, output data values (or seeds for generating GLUT) may be extracted through optical compensation of the display device 100.

For example, voltages values VDATA at specific tap points (or specific grayscale values are determined through the multi-time programming (MTP) process of the display device 100, and the determined voltage values VDATA are linearly coupled to each other, and thus all of the voltage values VDATA may be derived. That is, a first voltage curve CURVE_VR (or a first grayscale-voltage curve), that is, a first voltage curve including first gamma voltages, a second voltage curve CURVE_VG including second gamma voltages, and a third voltage curve CURVE_VB including third gamma voltages may be derived.

Meanwhile, during a multi-time programming process, voltage to luminance (or voltage to luminance ratio) at each of specific tap points may be calculated. Here, voltage to luminance, which indicates a change in luminance (or brightness) to a change in voltage, may be used to correct the first to third voltage curves CURVE_VR, CURVE_VG, and CURVE_VB. This voltage to luminance will be described in detail later with reference to FIG. 12.

Referring to FIG. 11, a differential voltage curve CURVE_V_D may be derived through first differentiation performed on each of first to third voltage curves CURVE_VR, CURVE_VG, and CURVE_VB. In FIG. 11, an example of a differential voltage curve CURVE_V_D for any one of the first to third voltage curves CURVE_VR, CURVE_VG, and CURVE_VB is illustrated. Differential voltage curves for the remaining ones of the first to third voltage curves CURVE_VR, CURVE_VG, and CURVE_VB may appear in a form similar to that of the differential voltage curve CURVE_V_D.

The differential voltage curve CURVE_V_D may be divided into first to fourth sections SECTION1 to SECTION4 depending on the grayscale value. For example, tap points are preset based on the inflection points of the differential voltage curve CURVE_V_D (or the first voltage curve CURVE_VR), and the first to fourth sections SECTION1 to SECTION4 may be distinguished from each other based on the tap points.

The first section SECTION1 may be a high-grayscale section corresponding to relatively high grayscale values, and the differential voltage curve CURVE_V_D in the first section SECTION1 may have a constant unrelated to the change in a grayscale value. That is, in the first section SECTION1, the value of the differential voltage curve CURVE_V_D (or the differential value of the first voltage curve CURVE_VR (see FIG. 10) may be set or adjusted to a constant value.

The second section SECTION2 may be a middle-grayscale section corresponding to grayscale values located at a relatively middle position, and the differential voltage curve CURVE_V_D in the second section SECTION2 may have a value decreasing with an increase in the grayscale value. That is, in the second section SECTION2, the differential voltage curve CURVE_V_D may be represented by a linear equation or may be adjusted to be represented by a linear equation.

The third section SECTION3 may be a low-grayscale section corresponding to relatively low grayscale values, and the differential voltage curve CURVE_V_D in the third section SECTION3 may be represented by a quadratic equation or may be adjusted to be represented by a quadratic equation.

The fourth section SECTION4 may be an ultra-low grayscale section corresponding to lowest grayscale values, and the differential voltage curve CURVE_V_D in the fourth section SECTION4 may be represented by a multi-order equation.

Thereafter, voltage curves for voltage values VDATA (e.g., the first voltage curve CURVE_VR illustrated in FIG. 10) may be reset or corrected based on the adjusted differential value.

Meanwhile, although, in FIG. 11, it is described that the values of the differential voltage curve CURVE_V_D are set based on four tap points (or first to fourth sections SECTIONI1 to SECTION4), embodiments according to the present disclosure are not limited thereto. For example, the differential voltage curve CURVE_V_D may be reset based on differential values at the middle grayscale values of the first to third sections SECTIONI1 to SECTION3 (i.e., three additional tap points) and differential values at initial four tap points. That is, through the seven tap points, curve fitting may be performed on the voltage curve (e.g., the first voltage curve CURVE_VR (see FIG. 10)).

According to some example embodiments, additional correction for the voltage curve (e.g., the first voltage curve CURVE_VR) may be performed based on the voltage to luminance calculated in the multi-time programming process, described above with reference to FIG. 10.

Referring to FIGS. 1 and 12, an actual luminance (or brightness) curve CURVE_M of the display device 100 driven using gamma voltages depending on the first voltage curve CURVE_VR may have brightness error in some grayscale values with respect to an ideal brightness curve CURVE_L0.

As illustrated in FIG. 12, when curve fitting for the first voltage CURVE_VR is performed through multi-time programming for a grayscale value of 121 121G and a grayscale value of 195 195G, the actual brightness curve CURVE_M may have brightness error at a middle grayscale value (e.g., a grayscale value of 158 158G. In this case, additional correction for the actual brightness curve CURVE_M may be performed based on voltage to luminance V2L at the grayscale value of 121 121G and voltage to luminance at the grayscale value of 195 195G. For example, by interpolating the voltage to luminance V2L at the grayscale value of 121 121G and the voltage to luminance at the grayscale value of 195 195G, voltage to luminance at a grayscale value of 158 158G may be calculated, and an additional voltage correction value corresponding to the brightness error may be calculated based on the voltage to luminance at a grayscale value of 158 158G. By means of this, the brightness curve CURVE_L (or an additionally corrected brightness curve) similar to the gamma curve (e.g., the 2.2 gamma curve) may be derived.

The additional voltage correction value between the grayscale value of 121 (121G) and the grayscale value of 195 (195G) may be set and stored as an offset. For example, the offset may be reflected in GLUT gamma data, described above with reference to FIG. 2.

The offset may be set as in the form of an offset curve CURVE_OFFSET, as illustrated in FIG. 12. For example, the offset curve CURVE_OFFSET may be represented by the square of the grayscale value (i.e., $y=x^2$) based on the grayscale value of 158 158G between the grayscale value of 121 121G and the grayscale value of 195 195G.

Because a brightness error curve CURVE_ERROR indicating brightness error is compensated for by the compensation curve CURVE_COMP depending on the offset, the error after compensation may substantially be '0' or may be eliminated.

As described above with reference to FIGS. 9 to 12, the gamma lookup table GLUT (and GLUT data) may be generated through the operation of linearly setting gamma voltages, the seed extraction operation of generating a GLUT through optical compensation, the operation of setting a voltage curve using differential values (i.e., the curve fitting operation), and the additional correction operation using voltage to luminance V2L (i.e., the operation of setting the offset of GLUT data).

Figures 13, 14:
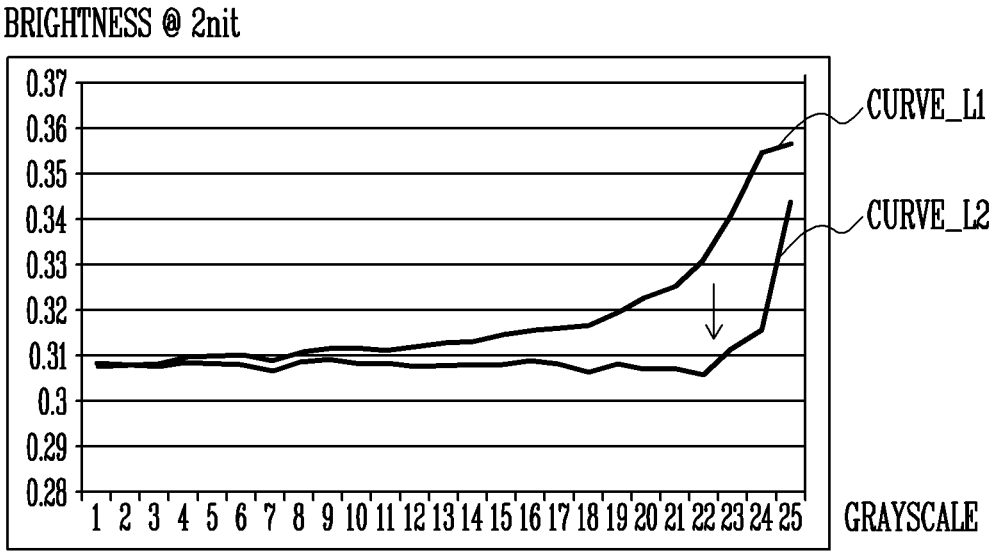
FIG. 13 is a diagram illustrating an offset for a dimming lookup table used in the second gamma compensator included in the display device of FIG. 1.
FIG. 14 is a diagram illustrating a change in a brightness curve depending on the offset set in FIG. 13.

FIG. 13 is a diagram illustrating an offset for a dimming lookup table used in a second gamma compensator included in the display device of FIG. 1. FIG. 14 is a diagram illustrating a change in a brightness curve depending on the offset set in FIG. 13.

First, referring to FIG. 13, the table may include an offset for representative grayscale values (or tap points). The offset may be set based on a grayscale value of 35 (or when the display device 100 (see FIG. 1) is driven using a dimming driving scheme, a grayscale value of 65), and a dimming level Data Dim of 2 (or a dimming value).

In other words, the offset for a dimming lookup table may be calculated by performing multi-time programming for a grayscale value of 65 on the display device 100 which drives dimming at a dimming level of 2. Further, offsets for all representative grayscale values may be calculated by interpolating the corresponding offset based on the dimming level and the grayscale value.

For example, as the grayscale value increases, the offset may be set in proportion to the square root of the grayscale value (i.e., Offset^1/2), whereas as the grayscale value decreases, the offset may be set in proportion to the grayscale value (i.e., Offset*ratio).

The calculated offsets may be reflected in dimming lookup tables P_DIM_SET1 to P_DIM_SET8, described above with reference to FIG. 5.

Referring to FIG. 14, brightness curves CURVE_L1 and CURVE_L2 of the display device 100 driven with brightness of 2 nits (i.e., a dimming level of 2) are illustrated.

The first brightness curve CURVE_L1 indicates brightness values for respective grayscale levels of the display device 100 which is operated based on a dimming lookup table in which the offset described above with reference to FIG. 13 is not reflected, and the second brightness curve CURVE_L2 indicates brightness values for respective grayscale levels of the display device 100 which is operated based on the dimming lookup table in which the offset described above with reference to FIG. 13 is reflected. Compared to the first brightness curve CURVE_L1, voltage values corresponding to a grayscale value of 23 in the second brightness curve CURVE_12 are set to relatively low values, and the display device 100 may display an image more closely matching an ideal 2.2 gamma curve.

Figure 15:
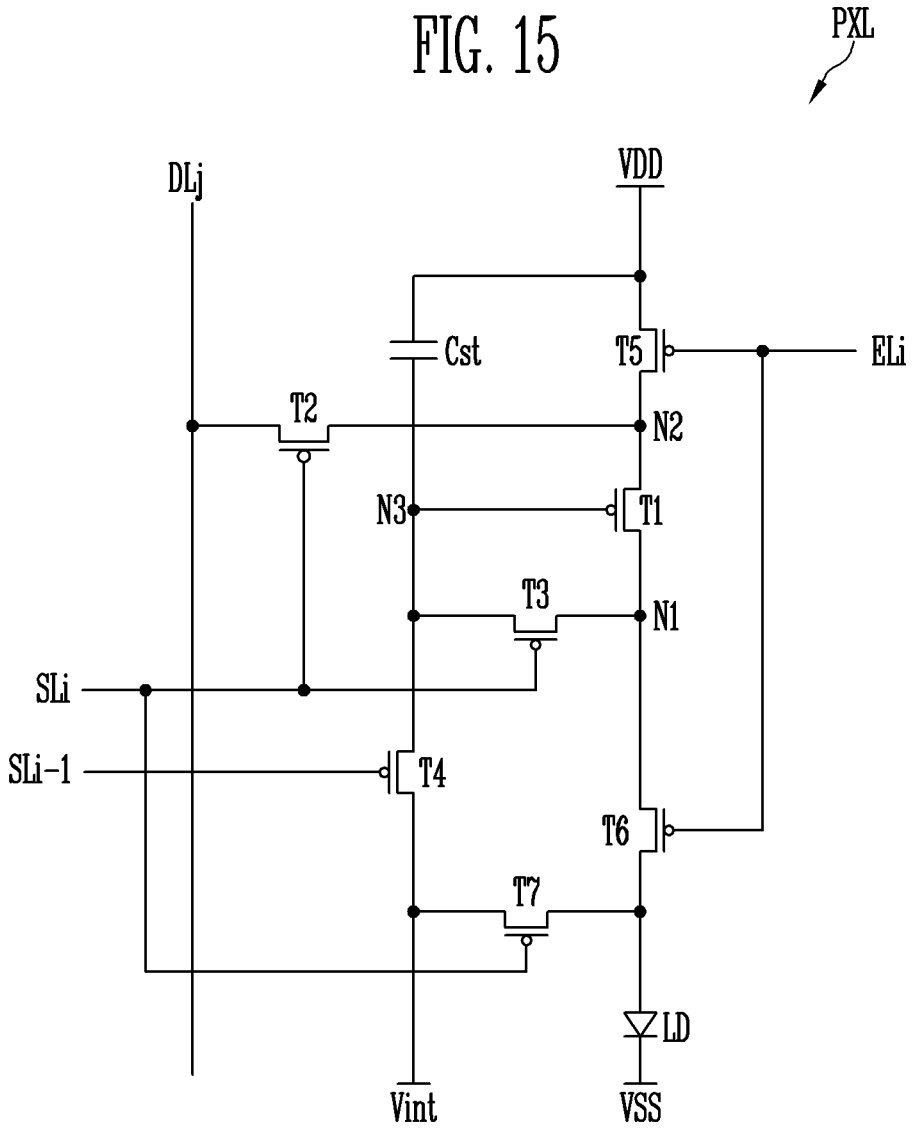
FIG. 15 is a diagram illustrating an example of a pixel included in the display device of FIG. 1.

FIG. 15 is a diagram illustrating an example of a pixel circuit included in the display device of FIG. 1.

Referring to FIG. 15, a pixel PXL may include first to seventh transistors T1 to T7, a storage capacitor Cst, and a light-emitting element LD. The number of transistors and capacitors may vary according to some example embodiments, however, and according to some example embodiments there may be additional or fewer transistors or capacitors, and additional electronic circuit components may be included, according to the design of the pixel circuit.

Each of the first to seventh transistors T1 to T7 may be implemented as a P-type transistor, but embodiments according to the present disclosure are not limited thereto. For example, at least some of the first to seventh transistors T1 to T7 may be implemented as N-type transistors.

A first electrode of the first transistor T1 (or a driving transistor) may be coupled to a second node N2, or may be coupled to a first power line (i.e., a power line to which a first supply voltage VDD is applied) via the fifth transistor T5. That is, the first transistor T1 may be configured to be connected to a first power supply supplying a high voltage VDD through a fifth transistor T5. A second electrode of the first transistor T1 may be coupled to the first node N1, or may be coupled to an anode of the light-emitting element LD via the sixth transistor T6. A gate electrode of the first transistor T1 may be coupled to a third node N3. The first transistor T1 may control the amount of current flowing from the first power line (e.g., connected to the first power supply supplying the high voltage VDD) into a second power line (i.e., a power line for transferring the second supply voltage or low voltage VSS) via the light-emitting element LD in accordance with the voltage of the third node N3.

The second transistor T2 (or a switching transistor) may be coupled between a data line DLj and the second node N2. A gate electrode of the second transistor T2 may be coupled to a scan line SLi. When a scan signal is supplied to the scan line SLi, the second transistor T2 may be turned on so that the data line DLj is electrically coupled to the first electrode of the first transistor T1.

The third transistor T3 may be coupled between the first node N1 and the third node N3. A gate electrode of the third transistor T3 may be coupled to a scan line SLi. When a scan signal is supplied to the scan line SLi, the third transistor T3 may be turned on so that the first node N1 and the third node N3 are electrically coupled to each other. Therefore, when the third transistor T3 is turned on, the first transistor T1 may be coupled in the form of a diode.

The storage capacitor Cst may be coupled between the first power line and the third node N3. The storage capacitor Cst may store a voltage corresponding both to a data signal and to a threshold voltage of the first transistor T1.

The fourth transistor T4 may be coupled between the third node N3 and an initialization power line (i.e., a power line for transferring an initialization supply voltage Vint). A gate electrode of the fourth transistor T4 may be coupled to a previous scan line SLi-1. The fourth transistor T4 may be turned on when a scan signal is supplied to the previous scan line SLi-1, and may then supply the initialization supply voltage Vint to the first node N1. Here, the initialization supply voltage Vint may be designated to have a voltage level lower than that of a data signal.

The fifth transistor T5 may be coupled between the first power line and the second node N2. A gate electrode of the fifth transistor T5 may be coupled to an emission control line ELi. The fifth transistor T5 may be turned off in a case where an emission control signal is supplied to the emission control line ELi, and may be turned on in the remaining cases.

The sixth transistor T6 may be coupled between the first node N1 and the light-emitting element LD. A gate electrode of the sixth transistor T6 may be coupled to the emission control line ELi. The sixth transistor T6 may be turned off in a case where an emission control signal is supplied to the emission control line ELi, and may be turned on in the remaining cases. Thus, according to some example embodiments, the fifth transistor T5 and the sixth transistor T6 may be configured to be turned off or turned on according to an emission control signal supplied to an emission control line ELi coupled to the gate electrodes of both the fifth transistor T5 and the sixth transistor T6.

The seventh transistor T7 may be coupled between the initialization power line and the anode of the light-emitting element LD. A gate electrode of the seventh transistor T7 may be coupled to the scan line SLi. The seventh transistor T7 may be turned on when the scan signal is supplied to the scan line SLi to supply the initialization supply voltage Vint to the anode of the light-emitting element LD.

The anode of the light-emitting element LD may be coupled to the first transistor T1 via the sixth transistor T6, and the cathode thereof may be coupled to the second power line. The light-emitting element LD may emit light with a brightness (e.g., a set or predetermined brightness) in accordance with the current supplied from the first transistor T1. The first supply voltage VDD may be designated to have a voltage level higher than that of the second supply voltage VSS so that current flows through the light-emitting element LD.

The display device according to embodiments of the present disclosure may output gamma voltages more closely matching an ideal gamma curve by converting an input grayscale value into a data value corresponding to a 2.2 gamma curve using a preset gamma lookup table. Therefore, brightness error may decrease, or there may be fewer instances of brightness error.

Further, the display device may additionally compensate for data values using a dimming lookup table including correction values for a larger number of tap points, thus decreasing brightness error even during dimming driving of the display device.

The scope of the present disclosure is not limited by detailed descriptions of the present specification, and should be defined by the accompanying claims. Further, all changes or modifications of the present disclosure derived from the meanings and scope of the claims, and equivalents thereof should be construed as being included in the scope of the present disclosure.

What is claimed is:

1. A display device, comprising:

a display panel comprising a plurality of pixels;

a power supply configured to supply first and second supply voltages to drive the pixels;

a brightness compensator configured to generate a first data correction value corresponding to a voltage level of the second supply voltage and the and to output a first corrected data value by performing a multiply operation on a first input data value and the first data correction value;

an interpolator configured to calculate a first voltage value corresponding to the first corrected data value using a preset gamma lookup table;

a first gamma compensator configured to calculate a first voltage correction value corresponding to a voltage level of the second supply voltage and to calculate a first output data value by performing an addition operation on the first voltage value and the first voltage correction value;

a gamma voltage generator configured to generate a plurality of gamma voltages having a linear relationship; and a data driver configured to select a first gamma voltage from among the gamma voltages based on the first output data value and to provide the first gamma voltage, as a data voltage, to the display panel, wherein: the first data correction value is represented by P bits, where P is a natural number, the first input data value is represented by Q bits, where Q is a natural number, the first corrected data value is represented by P+Q−1 bits, and wherein the interpolator is configured to:

determine a range of the first voltage value based on high-order R bits of the first corrected data value, where R is a natural number less than P, and generate the first voltage value by interpolating the range of the first voltage value based on low-order bits of the first corrected data value indicating remaining bits of the first corrected data value.

2. The display device according to claim 1, further comprising:

a second gamma compensator configured to select at least one of a plurality of dimming lookup tables based on a dimming value and to output the first corrected voltage value by correcting the first output data value based on the at least one of the plurality of dimming lookup tables, wherein the data driver is configured to receive the first corrected voltage value as the first output data value.

3. The display device according to claim 2, wherein:

each of the dimming lookup tables includes gamma correction values that are set according to each of representative grayscale values, and the second gamma compensator is configured to select a first dimming lookup table and a second dimming lookup table based on the dimming value, generate an interpolated lookup table by interpolating gamma correction values included in the first dimming lookup table and gamma correction values included in the second dimming lookup table based on the dimming value, and correct the first voltage value using the interpolated lookup table.

4. The display device according to claim 3, wherein a number of representative grayscale values is twice or more as large as a number of reference taps included in the gamma voltage generator.

5. The display device according to claim 3, wherein the second gamma compensator is configured to generate a gamma correction value for the first corrected voltage value by interpolating correction values, and to perform an addition operation interpolated on the first corrected voltage value and the gamma correction value.

6. The display device according to claim 3, wherein:

each of the dimming lookup tables further includes an offset that is set for a first representative grayscale value, among the representative grayscale values, and with respect to the first representative grayscale value, the offset is set in proportion to a square root of a corresponding grayscale value as the corresponding grayscale value increases, and is set in proportion to the corresponding grayscale value as the corresponding grayscale value decreases.

7. The display device according to claim 1, wherein:

the preset gamma lookup table includes first gamma data, the first gamma data includes a minimum voltage value of the range of the first voltage value and a delta voltage value, and the delta voltage value is a difference between a maximum voltage value of the range of the first voltage value and the minimum voltage value.

8. The display device according to claim 7, wherein the interpolator is configured to interpolate the delta voltage value of the first gamma data based on the remaining bits of the first corrected data value.

9. The display device according to claim 1, wherein:

the first input data value and the first output data value are located on a grayscale-voltage curve, a differential value of the grayscale-voltage curve has a constant value in a first section, and is represented by a linear equation in a second section, and input data values corresponding to the first section are greater than input data values corresponding to the second section.

10. The display device according to claim 9, wherein:

the differential value is represented by a quadratic equation in a third section, and input data values corresponding to the third section are less than the input data values corresponding to the second section.

11. The display device according to claim 9, wherein:

a reference differential value of a representative grayscale value is determined in an optical compensation process for setting a data voltage for the representative grayscale value, and the constant value and the linear equation are set based on the differential value.

12. The display device according to claim 1, wherein the gamma voltages have a linear relationship with the first output data value.

13. A display device, comprising:

a display panel comprising a plurality of pixels;

an interpolator configured to generate a first voltage value corresponding to an input data value using a preset gamma lookup table;

a gamma compensator configured to select at least one of a plurality of dimming lookup tables based on a dimming value and to calculate a first output data value by correcting the first voltage value based on the at least one of the plurality of dimming lookup tables;

a gamma voltage generator configured to generate a plurality of gamma voltages having a linear relationship; and a data driver configured to select a first gamma voltage from among the gamma voltages based on the first output data value, and to provide the first gamma voltage, as a data voltage, to the display panel, wherein:

each of the dimming lookup tables includes gamma correction values that are set according to each of representative grayscale values, and a second gamma compensator is configured to select a first dimming lookup table and a second dimming lookup table from among the dimming lookup tables based on the dimming value, generate an interpolated lookup table by interpolating gamma correction values included in the first dimming lookup table and gamma correction values included in the second dimming lookup table based on the dimming value, and correct the first voltage value using the interpolated lookup table.

14. The display device according to claim 13, wherein the gamma compensator is configured to generate a gamma correction value for the first voltage value by interpolating correction values in the interpolated lookup table, and perform an addition operation on the first voltage value and the gamma correction value.

15. The display device according to claim 13, wherein:

the preset gamma lookup table includes first gamma data, and the first gamma data includes a minimum voltage value of the range of the first voltage value and a delta voltage value, and the delta voltage value is a difference between a maximum voltage value of the range of the first voltage value and the minimum voltage value.

16. The display device according to claim 15, wherein the interpolator is configured to interpolate the delta voltage value of the first gamma data.

* * * * *